US008813378B2

(12) United States Patent
Grove

(10) Patent No.: US 8,813,378 B2
(45) Date of Patent: Aug. 26, 2014

(54) SYSTEM AND METHOD FOR DRAFTING GARMENT PATTERNS FROM PHOTOGRAPHS AND STYLE DRAWINGS

(76) Inventor: Carol S. Grove, Brooklyn, NY (US)

( * ) Notice: Subject to any disclaimer, the term of this patent is extended or adjusted under 35 U.S.C. 154(b) by 285 days.

(21) Appl. No.: 13/474,143

(22) Filed: May 17, 2012

(65) Prior Publication Data

US 2013/0305547 A1 Nov. 21, 2013

(51) Int. Cl.
*A41H 1/00* (2006.01)

(52) U.S. Cl.
USPC ..... 33/17 A; 33/17 R; 345/665; 700/132

(58) Field of Classification Search
USPC ..... 33/17 A, 17 R; 345/665; 700/132
See application file for complete search history.

(56) References Cited

U.S. PATENT DOCUMENTS

| | | | | | |
|---|---|---|---|---|---|
| 342,216 | A | | 5/1886 | McDowell | |
| 689,361 | A | * | 12/1901 | Moe | 33/17 R |
| 1,101,140 | A | | 6/1914 | Morrison | |
| 1,236,272 | A | * | 8/1917 | Costley | 177/5 |
| 2,159,035 | A | * | 5/1939 | McGrath, Jr. | 33/2 R |
| 2,869,236 | A | | 1/1959 | Franklin | |
| 3,383,770 | A | * | 5/1968 | Xenakis | 33/2 R |
| 3,902,182 | A | * | 8/1975 | Hillborg | 396/3 |
| 3,964,169 | A | | 6/1976 | Bush | |
| 3,979,831 | A | * | 9/1976 | Lutz | 33/17 R |
| 4,104,800 | A | | 8/1978 | Dyal | |
| 4,184,260 | A | | 1/1980 | Brockman | |
| 4,293,959 | A | * | 10/1981 | Gioello | 2/243.1 |
| 4,307,517 | A | | 12/1981 | Casselberry | |
| 4,635,367 | A | | 1/1987 | Vigede | |
| 4,916,634 | A | * | 4/1990 | Collins et al. | 706/62 |
| 5,163,006 | A | | 11/1992 | Deziel | |
| 5,163,007 | A | | 11/1992 | Slilaty | |
| 6,415,199 | B1 | * | 7/2002 | Liebermann | 700/132 |
| 6,490,534 | B1 | | 12/2002 | Pfister | |
| 6,751,877 | B2 | | 6/2004 | Grove | |
| 6,809,728 | B2 | * | 10/2004 | Terauchi et al. | 345/420 |
| 6,968,075 | B1 | | 11/2005 | Chang | |
| 7,079,134 | B2 | | 7/2006 | Kung et al. | |
| 7,184,047 | B1 | | 2/2007 | Crampton | |
| 8,525,828 | B1 | * | 9/2013 | Bates | 345/419 |
| 2004/0049309 | A1 | | 3/2004 | Gardner et al. | |

FOREIGN PATENT DOCUMENTS

| | | |
|---|---|---|
| WO | WO2012/061834 | 5/2012 |

* cited by examiner

*Primary Examiner* — Christopher Fulton
(74) *Attorney, Agent, or Firm* — Gordon & Jacobson, PC

(57) ABSTRACT

Systems and methods are provided for drafting garment patterns from body photographs and garment style drawings as well as for creating adjustable pattern style drawings and for drafting garment patterns from the pattern style drawings. The garment patterns are adjusted by measurements obtained from photographs and selected body part circumferences of the user for whom the garment pattern is intended. After obtaining the measurement the system preferably automatically make such adjustments. The system includes a content generation side which creates pattern styles of garments and provides such pattern styles to an online store. The system also includes a user-side through which a user generates a user body outline and interacts with the online store to access such pattern style drawings for use in association with the body outline to draft garment patterns that are fully customized to the user.

33 Claims, 22 Drawing Sheets

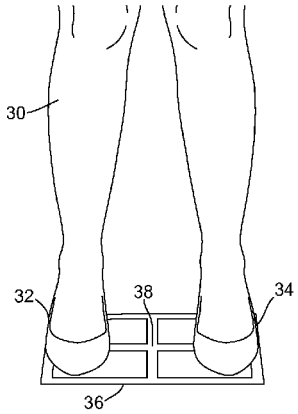
Fig. 9
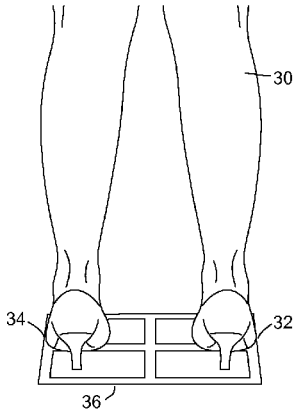
Fig. 10
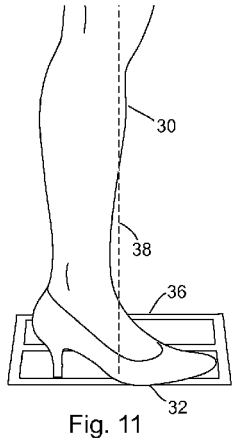
Fig. 11
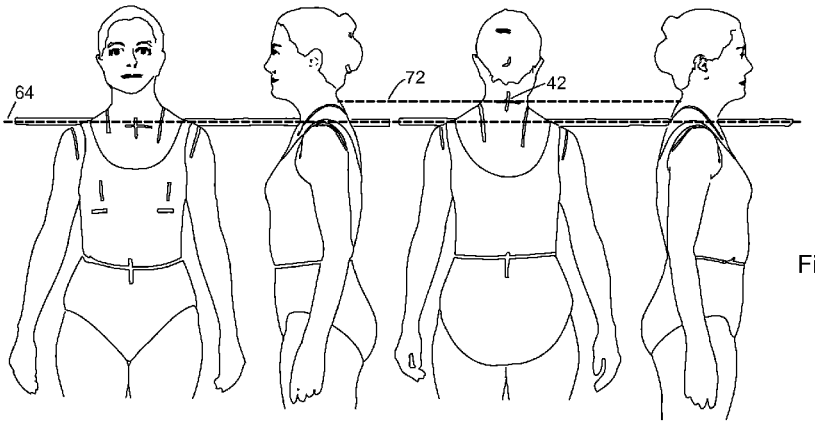
Fig. 13
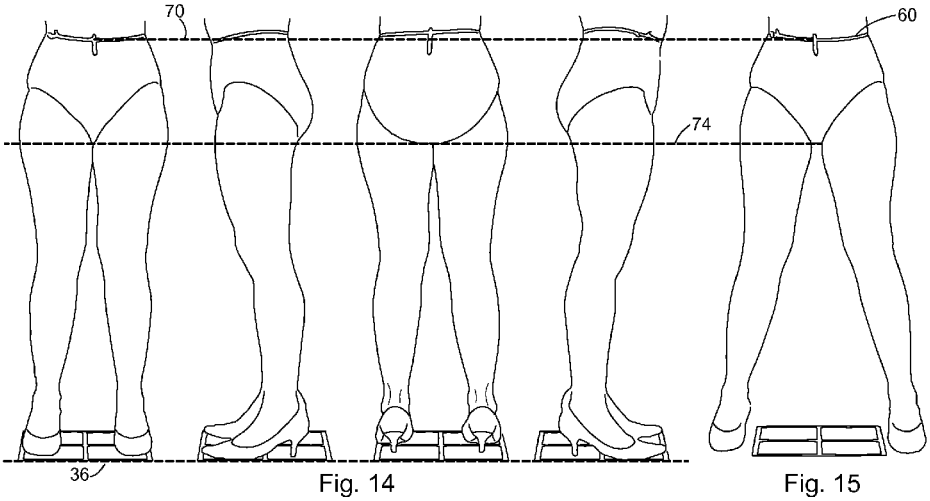
Fig. 14
Fig. 15
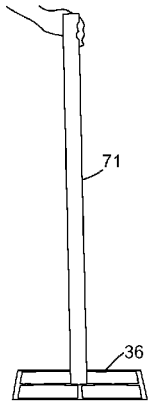
Fig. 16

3/4 VIEW
FOR VISUALIZATION

AERIAL VIEW
FOR VISUALIZATION

3/4 VIEW
FOR VISUALIZATION

AERIAL VIEW
FOR VISUALIZATION

SYSTEM AND METHOD FOR DRAFTING GARMENT PATTERNS FROM PHOTOGRAPHS AND STYLE DRAWINGS

BACKGROUND OF THE INVENTION

1. Field of the Invention

The present invention relates to systems and methods for obtaining accurate measurements for use in drafting garment patterns. More particularly, the invention relates to system and method of using photographs and garment drawings to accurately obtain circumferences, dart angles, most of the measurements and other parameters required to draft garment patterns having good fit.

2. State of the Art

The method for drafting garment patterns has remained unchanged in over 150 years, and most likely has not changed since people started to fit clothing. While styles have changed, and the way clothes fit has changed, and body types have changed, the method for making patterns is still the same.

There are two main methods for making patterns that are in use: draping and drafting.

Draping is the art of manipulating fabric on a dress form to achieve the desired fit and style. If it is used for custom patterns, it requires a dress form that is shaped and sized the same as the individual being fit (subject). It also requires a learned skill.

Drafting, also called flat patternmaking, requires one to take many measurements of the subject using a tape measure, and then uses a formula to plot those measurements on paper to make a basic pattern called a block or sloper. The sloper is further manipulated by slashing and spreading or other methods to achieve the desired style. After that, a test garment called a muslin is sewn and fitted to the wearer. Then adjustments to the pattern are made. Depending on someone's level of skill, five or six muslins might be made before one is satisfied with the results.

Innovations in pattern drafting throughout the years generally fall into one of several categories. A first such category includes improvements of plotting measurement onto paper. The measurements are taken by another instrument such a tape measure and plotted using a new device. Examples are disclosed in U.S. Pat. No. 342,216 and U.S. Pat. No. 4,104,800. Computerized pattern drafting software falls into category because the measurements need to be input from another source.

A second category includes improvements in taking measurements. Examples are described in U.S. Pat. No. 1,101,140, U.S. Pat. No. 2,869,236 and U.S. Pat. No. 4,635,367. In addition, certain advances may comprise improvements in both the first and second categories, such as U.S. Pat. No. 6,751,877.

A third category includes improvements to target a specific fit or measurement problem. Examples are described in U.S. Pat. No. 3,964,169, U.S. Pat. No. 4,184,260 and U.S. Pat. No. 4,307,517.

A fourth category includes improvements in comparing an individual's measurements or shape with the measurements or shape of a standard body from which a pattern has already been drafted. The differences are used to adjust the ready-made pattern to fit the individual. Examples are described in U.S. Pat. No. 6,490,534 and U.S. Pat. No. 5,163,006. Both such patents teach using photographs to take some measurements, but do not teach how to make patterns. Further, the patents teach using ellipses for the circumferences of the individual's body. But this leads to inaccurate measurements, as the human body in cross-section is not elliptical in shape.

A fifth category includes three-dimensional computerized modeling of an individual's body for the purpose of making patterns. Most use the three-dimensional computerized models as if they were an actual person, and take the same measurements that have been used to draft patterns for 150 years.

While there have been numerous innovations for patternmaking throughout the years, the problem of generating a pattern tailored to fit an individual still has not been adequately solved. This is due to the inability to obtain the necessary measurements from an individual in the manner in which it has been up to now performed. The measurements used to date to draft patterns are all measurements that can be taken on the surface of an individual. Most measurements currently used to draft patterns are length, width and circumference measurements, but there is more information needed for great fit than what can be gathered with a tape measure.

Current systems do not permit the measurement of dart intake angles with a tape measure. Thus, while it is possible to measure the difference between, e.g., the bust and waist circumferences, it is not known from such measurements how much of that difference should be distributed at the front, the side or back of the pattern.

Further, the "full circumferences" cannot be measured with a tape measure. For example, a woman's hips are measured at the fullest part of her buttocks, but she may be hollow in front at that point. A tape measure cannot tell you how much to add to the hips to account for this.

In addition, it is not known from tape measurements the correct horizontal and vertical balance for a pattern. For example, when measuring vertical lengths for a bodice, it cannot be known by using a tape measure how much of that length should be distributed above the bust level and how much below. Also, a tape measure can take many circumference measurements, but how those circumferences are horizontally and vertically related to one another cannot be measured using a tape measure. However such information is essential for great fit, especially for pants.

In addition to not achieving great fit with a tape measure, the process of taking all the measurements required is difficult and time consuming. To draft a pattern, 25 to 50 measurements are required, depending on the particular drafting method used. If one is asymmetrical, then double the amount of measurements are needed. It is difficult to measure most measurements oneself such as the back and shoulder, so it usually requires a patient partner. To take accurate measurements requires carefully marking lines and points of measure and filling in hollows. Thus, measuring is a difficult, time consuming, two person process that even then does not result in the desired garment fit.

That is, the state of the art provides systems and methods in which patterns are drafted in these steps:

1) Many measurements are take against the body of the subject being fit.

2) The measurements are plotted on paper to make a basic pattern (also referred to as a sloper or block).

3) A physical or mental image of a desired garment style is obtained in the form of a sketch, photograph or idea.

4) The block is cut, slashed, spread or drawn to attempt to create a pattern for the desired style for the subject.

5) Many trial garments are made and adjusted to achieve a desired style and fit.

This existing approach is less than desirable.

SUMMARY OF THE INVENTION

In accord with the invention, a system and method are provided for drafting garment patterns from style drawings which are modified by measurements obtained from photographs and selected body part circumferences of the user for whom the garment pattern is intended.

More particularly, pattern styles are created using a pattern style creator system including computer-aided design (CAD) software program and associated hardware, including e.g., a central processor unit, a graphics processor (separate or integrated into the central processing unit), a display, and an input device. Each pattern style includes a style drawing and an associated pattern for making a garment matching the style drawing. The pattern style is created by providing a general 'mannequin' outline having the contours of generic human form, creating a style drawing on the mannequin outline having parametric constraints (geometric and dimensional), and generating pattern pieces from the style drawing, the pattern pieces having corresponding parametric constraints and defined based on input of a user's measurements obtained from a body outline, defined below, and circumferential measurements of selected body parts, as well as other adjustments, as described below. In accord with a preferred aspect of the invention, the pattern styles are preferably stored on a server in communication and more preferably provided as part of an online retail store at which customer users can purchase or otherwise acquire the pattern styles. The pattern styles are preferably provided in combinations for viewing and creating whole garments, but may also be provided piecemeal, as add-ons for various individual garment components, e.g., different sleeve styles for a blouse.

In order to work with the pattern styles, the user creates a user body outline to which a style drawing of the pattern styles are fit, and against which the pattern of the pattern style is modified. To create the body outline, the user generates photograph image files and acquires specific body part circumferences (including the neck (for collars), bust, waist, hip, thigh (for pants) and bicep (for sleeve)), preferably by tape measure. The user is provided with appropriate software which may comprise multiple software packages or a single integrated software program. Such software includes an outline generator which imports the digital photograph files, generates a scaled user body outline having several views from the digital photograph files, and calculates body measurements on the generated body outline.

The user's computer is connected via Internet access or other telecommunications to the online retail store. The software also allows the user to browse the online retail store for pattern styles, optionally download the style drawing of the pattern style (without downloading the pattern pieces) for placement over the body outline, preferably snap the style drawing into alignment onto the user's body outline using alignment marks, and automatically adjust the style drawing to fit the user's body outline. This allows the user to preview the selected pattern style on the user's body outline and decide whether it is flattering or otherwise desirable or as expected before purchasing the pattern and expending the considerable work into cutting and sewing a garment and the additional cost of the fabric and other materials required in making the garment. In accord with the invention, the adjustment of the style drawing, and pattern pieces discussed below, to the user's body outline for a proper fit of the garment, the system uses a body part multiplier which is calculated using measurements obtained from the measured circumferences and the measurements on the body outline. The measured circumferences for each body part are multiplied by the body part multiplier to determine the correct circumference on the pattern for the respective body part for the fabric to lay right and have good fit.

Once the user decides to purchase the pattern pieces corresponding to the style drawing, such is purchased. (It is appreciated that the pattern pieces may be purchased at the same time the style drawing is acquired or even before acquiring the style drawing.) The software adjusts the pattern pieces to the user's body outline such that the pattern pieces accommodate the user's body for good fit, as discussed above with respect to the style drawing. The software also allows adjustments for other factors, e.g., wearing ease, and available user-selectable options that may be specific to the pattern style, including, length of pants and skirts, pocket size, etc. Once the user has completed entering the user adjustments, the user can output the pattern pieces to a temporary or saved image file for processing by a local printer or transferring to a remote printer, which outputs a printed garment pattern.

In accord with another aspect of the invention, the pattern style creator software or another software package is adapted for the needs of a garment designer. The software includes a general mannequin outline, as described above with respect to the pattern style creator system and/or a body outline generator, as described above with respect to the user-side software, which allows a body outline of a designer's fit model or a generic outline for a standard customer, to be generated and stored from photograph image files imported into the software. The body part circumferences for the body to which the garment will be fit, e.g., a mannequin, a standard customer, or a fit model are input into the software. The software provides basic garment drawings, e.g., silhouettes of skirts, pants, bodices, etc., as well as the patterns corresponding to the basic garment drawings and basic pattern tools to modify the drawings and corresponding patterns with additional seams, pleats, shearing, etc. The garment drawings, patterns and pattern tools are formulaic in structure and desired to be automatically adjusted to assume good fit to the body outline based on the input circumferences and measurements from the body outline. The designer places the basic garment drawing onto the body outline and manipulates the drawing. That is, a basic skirt can be reconfigured between a tapered skirt and an A-line skirt, as desired, and the software ensures the modified skirt pattern maintains appropriate fit to the body outline. Once the designer is satisfied with the look of the modified and adjusted garment drawing on the body outline, image files for the garment pattern pieces are output to a temporary or saved image file for processing by a local printer or transferring to a remote printer. Thus, the software allows a garment designer to visualize a garment and then measure their "vision" so that the drafted pattern reflects their design on the first try, rather than guessing how much to change a sloper and then working to achieve it by trial and error.

BRIEF DESCRIPTION OF THE DRAWINGS

FIGS. 9 through 11 are front, back and side views of user feet relative to a reference mark.

FIGS. 13, 14 and 15 are top and bottom photographic views.

FIG. 16 is a photographic view of a reference measurement scale.

DETAILED DESCRIPTION OF THE PREFERRED EMBODIMENTS

In accord with the invention, systems and methods are provided for creating adjustable style drawings and for drafting garment patterns from the style drawings. The garment patterns are adjusted by measurements obtained from photographs and selected body part circumferences of the user for whom the garment pattern is intended. After obtaining the measurements the system preferably automatically makes such adjustments.

Figure 70:
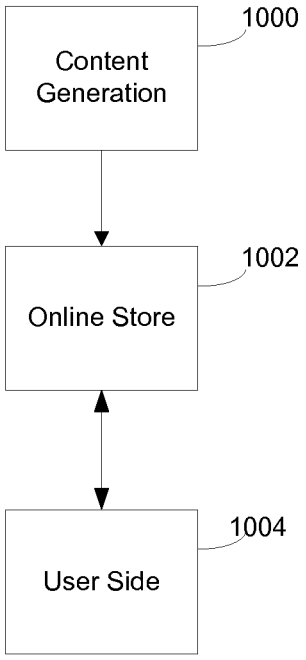
FIG. 70 is a schematic overview of the system of the invention according to the invention.

Referring to FIG. 70, the system and method includes a content generation side 1000 which creates pattern styles of garments and provides such pattern styles to an online store 1002. The system and method also include a user-side 1004 which generates a body outline and interacts with the online store 1002 to access such pattern styles for use in association with the body outline to draft garment patterns that are customized to the user.

More particularly, in the content generation side of the invention, pattern styles are created. A pattern style includes, (i) a style drawing, and (ii) an associated pattern for making a garment matching the drawing. The style drawing is a visual representation of a how a garment will look on a body, and is preferably represented relative to a body outline, discussed below. The style drawing is a line representation of the garment and is adjustable in view of various parametric constraints. The style drawing is preferably shown and modified relative to an outline of a body form. The pattern is a specific pattern that can be printed on paper or other materials and positioned on fabric to provide instruction to the user for the numerous cuts required for making a garment that will look like the style drawing. The pattern is constrained to the style drawing; if the style drawing is modified in shape, the associated pattern is automatically modified in shape for a proper fit relative to a user subject, discussed below. Importantly, the pattern includes no standard dimensions, angles, or sizes; it is completely customized to a user based on formulas that link to the style drawing, modifications to the style drawings based on a body outline of a user, and specific circumferential measurements of selected body parts of a user. The system of the invention is intended to improve the method of drafting patterns so that the patterns provide garments that result in significantly improved fit as well as having the intended appearance of the desired style Pattern styles are created using a pattern style creator system including computer-aided design (CAD) software and associated hardware for running the software, including e.g., a central processor unit, a graphics processor that may be separate or integrated into the central processing unit, a display for displaying a user interface and output from the software, and an input device for inputting data and instructions to the software. The input device may be integrated into the display, utilizing a contact or touch sensitive display. Alternatively, tablets, mice, trackballs, keypads, etc. may alone or in various combination be used to input necessary or desired information to the system for processing.

The pattern style creator system also provides at 1010 (FIG. 71) a generic 'mannequin' outline having the contours of a human form over which the style drawing is formed. The mannequin outline is preferably relatively non-descript, as end-users are initially shown the style drawings as displayed on the mannequin outlines and it is desirable that the end user can visualize themselves in a garment according to the pattern style, rather than any other particular individual. Nevertheless, the mannequin outlines can be designed to the anticipated shape of or other marketplace considerations for an intended customer for the particular the pattern style. Each body outline of a mannequin is provided with four views (front, back, and left and right sides) and a representative set of dimensions. Such dimensions include the circumferences of the specific body parts, including the neck (for collars), the bust, the waist, the hips, the thighs (for pants), and the biceps (for sleeves). In addition, the body outline is scaled relative to a determined size so that other dimensions can be determined from the various views.

Figure 71:
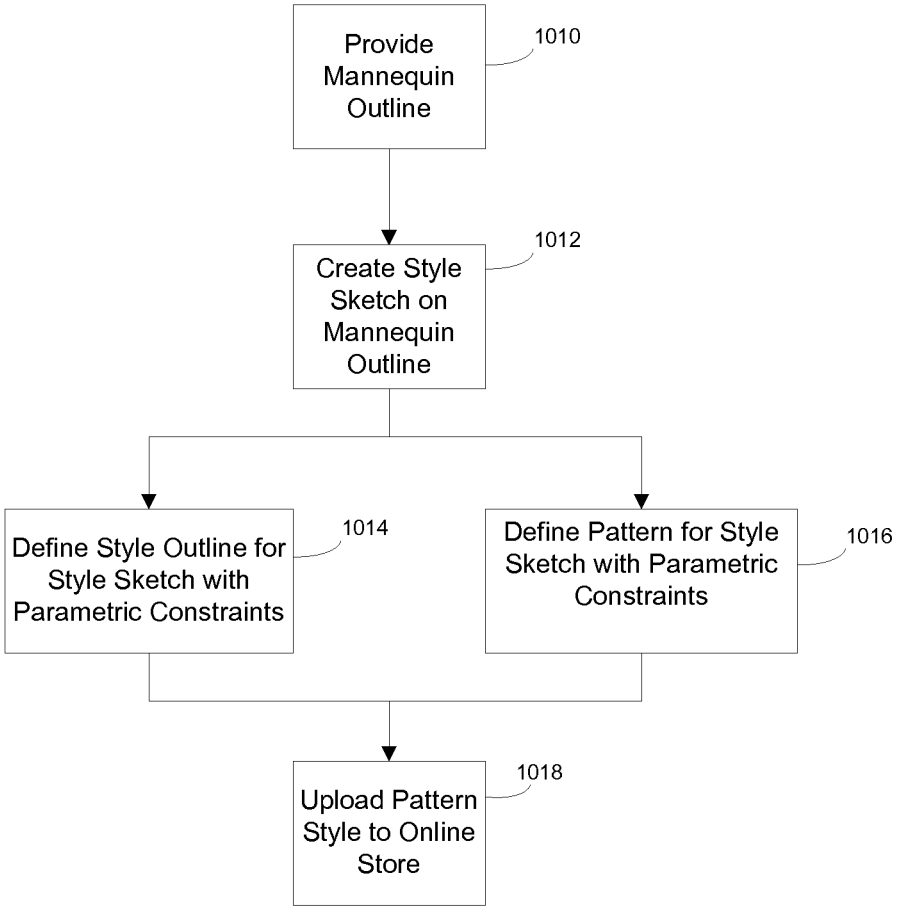
FIG. 71 is a flow chart of a method of pattern style creation according to the invention.

Once the mannequin outline is provided at 1010, the style drawing is created at 1012 on or over the mannequin outline, as indicated in FIG. 71. The style drawing includes the contours of a garment as drawn on the mannequin outline. The style drawing is preferably created using one or more predefined garment drawings, which are made available from a set of tools provided within the style creator software. The tools preferably provide predefined garment drawings for bodices, sleeves, skirts, dresses, and pants. Optionally, other pre-defined garment drawings may be provided. The user may select one or more garment drawings, maneuver them over the mannequin outline, and manipulate them to create a new style drawing. In addition to utilizing predefined garment drawings, the user can free hand sketch all or a portion of the style drawing over the outline.

After completion of the style drawing the style drawing and its counterpart pattern, whether predefined or user created, are preferably defined with, provided with, or subject to constraints as indicated at 1014 and 1016 in FIG. 71. Such constraints can be included in the pre-defined garment drawing pieces or may be calculated by the software or user once it is indicated that the style drawing is complete and that a pattern is to be created. The constraints are parametric constraints, which are restrictions and associations that are applied to geometry. There are two types of parametric constraints: geometric and dimensional. Geometric constraints are used to control the relationships of objects with respect to each other. Geometric constraints contain controls for coincident (with other object points), fix (to an absolute location), horizontal, vertical, concentric, tangent, parallel, perpendicular, colinear, smooth (join splines), equal, and symmetric (matches characteristics about an axis). Dimensional constraints are used to control the distance, angle, radius and length values of objects. Dimensional constraints can be formulaic in nature and linked to other geometry in the drawing. By defining the style drawing with such parametric restraints, the style drawing can be later modified in accord with input of a user's measurements as well as other adjustments, as described below.

The style drawings preferably have the appearance of line drawings; they are preferably not expressive like fashion drawings. For example, a flared skirt is provided with straight edges and a straight hem, and is not drawn with folds and ripples the way a soft, fluid fabric would fall. However, the style drawing may be able to be "faked", such that the folds and ripples can be drawn on the sketch, but the 'inactive' expressive lines of the style drawing corresponding to such folds and ripples are shown in a visually differentiated manner (in color, broken, weight, etc.) from the active lines of the style drawing which affect drafting the pattern of the garment, and which would remain, e.g., straight and flared. In addition, it is preferred that perspective be absent from the style drawing as much as possible. The style drawing is created on the mannequin outline as if every level were at eye-level so that a hem that is level with the floor would be a straight line instead of a slight curve as it usually would be depicted in a sketch. A curve at the hemline would indicate a shaped, shirttail type hem.

In accord with the invention, the parametric constraints of the style drawings and patterns are set based on the representative scaled dimensions and circumference measurements for the mannequin outline discussed above, and the style drawing and patterns can be later adjusted based on user input dimensions for a user's same body parts; i.e., the neck (for collars), the bust, the waist, the hips, the thighs (for pants), and the biceps (for sleeves), as discussed below. This permits a bodice style and pattern to be constructed to accommodate each individual's cross section of the underlying body part in a manner which has not previously been done before.

Figure 1:
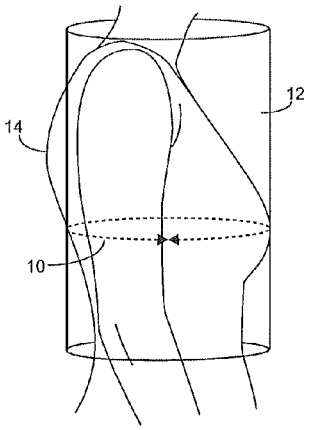
Fig. 1 PRIOR ART
FIG. 1 is a view of a schematic bodice sized to fit on a human body according to standard measuring techniques.
Figure 2:
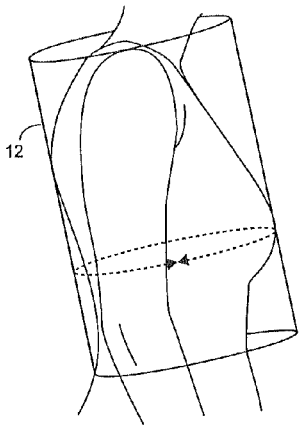
Fig. 2 PRIOR ART
FIG. 2 is a view of the fit of the schematic bodice fit on the human body.

That is, in the prior art, circumferences measured directly with a tape measure do not provide the necessary measurements to make patterns for well fitting garments. By way of example, referring to FIG. 1, standard drafting formulas use the bust circumference 10 as the circumference for a bodice 12 (represented by a tube for visualization). However, when the subject has a low full bust and high protruding shoulder blades, the measured bust circumference will not be large enough to account for the depth of the upper back at 14. As a result, a garment made from such a bodice pattern 12 will pitch back to accommodate the depth at the upper back as shown in FIG. 2. Further, the dart intakes (angles) will be incorrect for this subject's shape, and the cross grain of the fabric will not be parallel to the floor (as desired) and will curve. Moreover, if the waist darts are relaxed for an easier fit, the garment will pitch back even more. Any garment made from this pattern will never look or feel right. Thus, using measurements obtained only from a tape measure it is not possible to measure the full circumference required for a bodice.

Figure 3:
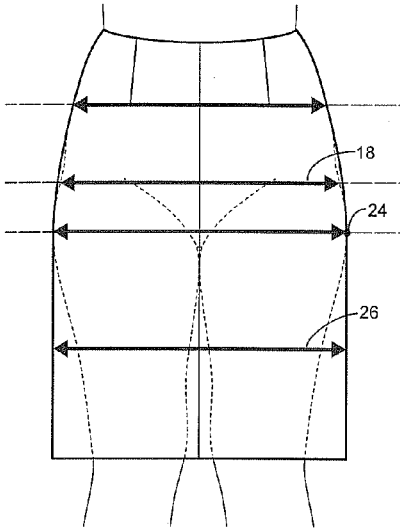
FIGS. 3 and 4 illustrate inaccuracies in standard fit of a skirt on a body outline in front and left side views.
Figure 4:
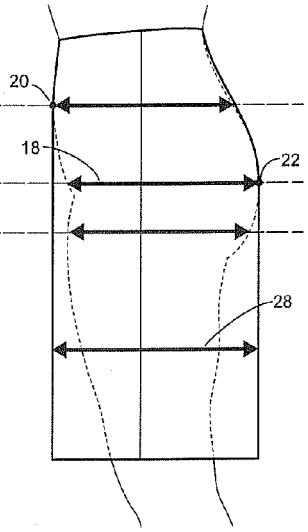

Also, referring to FIGS. 3 and 4, standard drafting formulas use the hip circumference (generally measured at 18) as the skirt circumference, but as in the bodice, this produces inaccuracies. The fullest point of the front is at 20. The fullest point of the back is point 22. The fullest point of the side is at 24. If the body circumference is measured at any of these points, an accurate circumference for the skirt does not result. The skirt circumference needs to be as wide as line 26 and the depth needs to extend from 20 to 22, as shown as line 28. There is no way of finding this circumference using a tape measure. Similar issues are present with other body parts indicated above.

Figure 5:
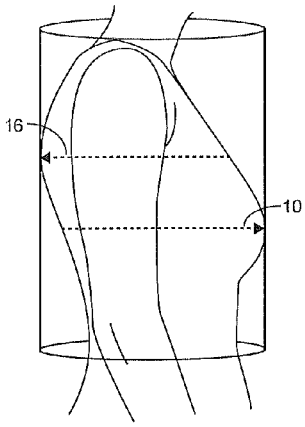
FIG. 5 is a view of a schematic bodice properly sized to fit on a human body according to the invention.

Referring to FIG. 5, in accord with the invention, the full circumference needed to accommodate both the bust circumference 10 and the upper back circumference 16 for a bodice is obtained by using the bust circumference 10 and a multiplier, with any pattern designed to accommodate any 'extra fabric' such that it is taken up with increased dart intakes. This method keeps the horizontal grain of the fabric parallel with the floor at the fullest points of the body which is ideal for great fit.

In accord with the invention, the full circumference measurement for proper fit of any such body part can be found when drafting patterns by using a body part (BP) multiplier. The formula to find the body part multipliers (BPM) for use in the invention is:

$$BPM = \frac{BP \text{ circumference}}{BP \text{ width} + BP \text{ depth}},$$

in which the BP circumference is measured with a tape measure (initially from a fit model or as provided from 'average' measurements, and later from actual end-user measurements), and the BP width and BP depth are determined by measurements on the body outline (initially from the mannequin outline and later from the end-user body outline). The BPM results from the following exemplar relationship which can be applied to other body parts as well: if the width at hip level 18 plus the depth of body part at hip level 18 multiplied by the BPM equals the hip circumference (as measured with a tape measure at the level of 18, then the (width along 26 plus the depth along 28) times the BPM equals the circumference of a tube that accommodates the fullest parts of the body. The measurements of the width and depth need to be at the same level the circumference is measured on the body.

As the pattern styles are created, the respective body parts are associated with the patterns, as well as the parametric constraints and variables for being modified by the respective body part multiplier.

After creation of the pattern styles, the pattern styles (style drawing and associated patterns) are preferably stored on a server accessible by a customer user as shown at step 1018 in FIG. 71. More preferably, the pattern styles are provided as part of an online retail store at which customer users can purchase or otherwise acquire the pattern styles. The pattern styles are preferably provided in combinations for creating whole garments, but may also be provided piecemeal, as add-ons for various individual garment components, e.g., different sleeve styles for a blouse. While an online store for the transaction of such pattern styles is an aspect of the invention, online stores for the transacting of digital merchandise will not be described in detail as the systems and operation thereof are generally well known.

The user side of the system is now described. In order for the user to use the patterns made available in the store, the user must create a user outline about which the style drawings can be referenced to show the user how a style will appear on her and have appropriate means to interact with the online store so that style drawings can be purchased or otherwise accessed and the style drawings can be modified relative to the user outline. As referenced above, the style drawing will automatically adjust to the user outline. As the style drawing adjusts, the associated pattern for the garment will automatically adjust for proper fit on the user.

The means for user interaction with the online store is preferably dedicated software loaded on a computer, but may be a standard browser. The software permits and facilitates the user accessing and browsing pattern styles from the online store, acquiring a style drawing of a selected pattern style into a user storage of acquired style drawings, modifying the style drawing of the selected pattern style (as described below) to be modified relative to the user's outline (generated as also described below), acquiring the pattern associated with the style drawing into a user storage for such patterns, and generating a pattern customized to the user's body shape for output to a printer device.

As described, user access to the pattern is preferably acquired separately from the style drawing. This permits the user to view the style drawing over the user's body outline to evaluate the 'fit' of the style drawing, which may be provided to or accessible to the user for free prior to purchasing the pattern. In addition, it may be possible for the user to view their body outline and style outline with faces, hair, accessories, colors and scanned fabrics so they can get a complete picture of how the final garment will look. It is appreciated that the pattern may be acquired at the same time as the style drawing and unlocked upon payment to use the pattern if the user is agreeable to the 'fit' of the style drawing to the user's body outline, or may be acquired in a separate transaction.

Thus, the user software is designed for commercial transaction, reading and viewing the style drawings and patterns, customizing the purchased styles and patterns, and outputting the patterns for printing for use in creating a garment. It is appreciated that the term 'acquiring' includes downloading into accessible storage or other access to the pattern styles such that the user has is capable of using the selected style drawing and patterns as described herein. In addition to online browsing, the user may browse the style drawings in a retail store, a catalog, a card system, or other offline form, and then use the online store to acquire a selected one of the pattern styles without online browsing therethrough. In addition style drawings and/or patterns may be made available offline on portable digital media such as discs (CD or DVD), memory cards, portable USB storage drives, or other storage media. The user may store all drawings and patterns in local or cloud storage, and/or may acquire a token, password or other credentials that permits all viewing and customization to occur on servers under control of the owner or licensor of the patterns. The user software may be an integrated software product or may include two or more integrated, associated or disassociated software programs.

Figure 72:
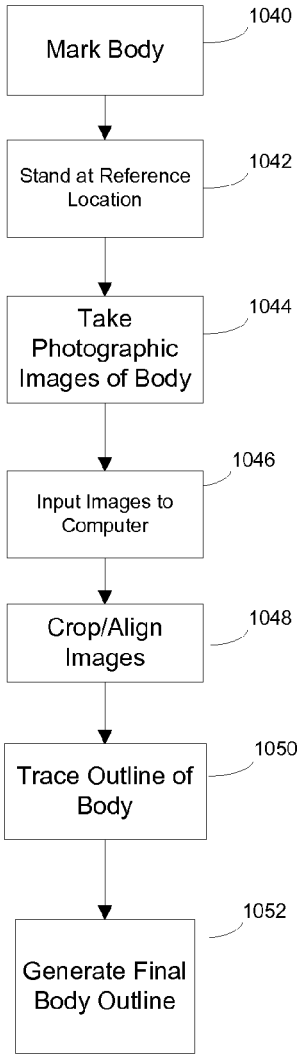
FIG. 72 is a flow chart of a method of generating a user body outline according to the invention.

In accord with the invention, the method of creating a user outline is now described, and generally set out in the flow chart of FIG. 72. To create the user outline, photographs of the user are taken and used. The method of taking the photographs can be simple to elaborate; from taking the photos with a self-timer at home, to actual photo booths set up in professional or retail establishments that take all views from different levels at once and automatically stitch the sections together. The photographs are preferably digital photos readily suitable for importing into computer-aided design (CAD) software programs as described below. Alternatively, the photographs can be printed photos which are then digitally scanned into a form suitable for such importation.

An exemplar photo booth for taking photographs can have an illuminated background and the body could be marked with reflective tape, so the only thing showing in the photos is the body silhouette and markings. In addition, edge detection algorithms and/or processing, or even human body recognition software can also be used to simplify (for the user) and expedite the process. The result will provide an accurate outline of the front, back and side views of the body, devoid of foreshortening and other distortions, placed at the same horizontal level and set to scale with the armhole, apex, neckline, center front, center back and waist marked and a means of finding the bottom of the armhole and crotch levels, as described further below.

An exemplar method for acquiring reasonably accurate photographs meeting the needs of the system is now described with respect to a female human subject 30. It is recognized that the system may also be applied to male human subjects, non-human subjects, mannequins, dolls, etc., and that the system and method can likewise be used to make patterns for garments therefor.

Figures 6, 7, 8:
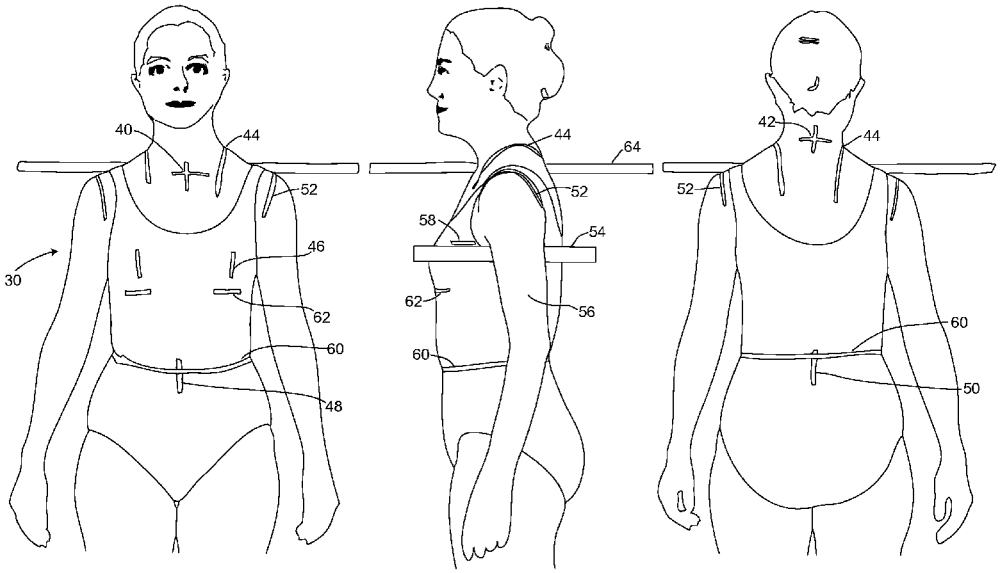
FIGS. 6 through 8 are front, side and back views of user body markings in preparation for photographs.

The body of the subject is preferably marked as indicated at step 1040 (FIG. 72) as follows. Referring to FIGS. 6 through 8, a narrow tape marks the center front neck 40, the center back neck 42, and the side neck 44 of the subject 30, extending downward for a few inches. The apex 46, the center front waist 48 and center back waist 50 are each marked vertically. Similarly, from mid-front to mid-back armholes are each marked vertically at 52. The armhole depth is marked by placing a ruler 54 under the arm 56 and its top edge traced on the front body with narrow tape 58. Narrow elastic 60 is tied around the waist. The under bust 62 can also be marked. Other marking indicia can be used other than tape and elastic, but these are inexpensive and easy to apply. A horizontal line 64 is preferably marked on the background behind the subject 30 to help align the photographs relative to each other.

Referring to FIGS. 9 through 11, while the subject 30 stands in a relaxed stance, the outside from one foot 32 to the outside of the other foot 34 is measured. A reference mark, e.g., such as square 36, of this width is marked on the floor, using e.g., painters tape and its center 38 is marked with an X or cross. The subject 30 stands with their weight centered about the center 38 of the reference square 36 and the sides of the feet 32, 34 touching the outer edges of the square for all photographic views taken, as indicated at step 1042 (FIG. 72).

It is also preferred that the subject 30 wear standard under garments. If desired, form fitting clothes such as a leotard may also be worn. The subject's hair should be pulled away from the shoulder and neck area to provide a view of this area. The subject should wear standard shoes. It is best to take the photos against a solid background.

Figure 12:
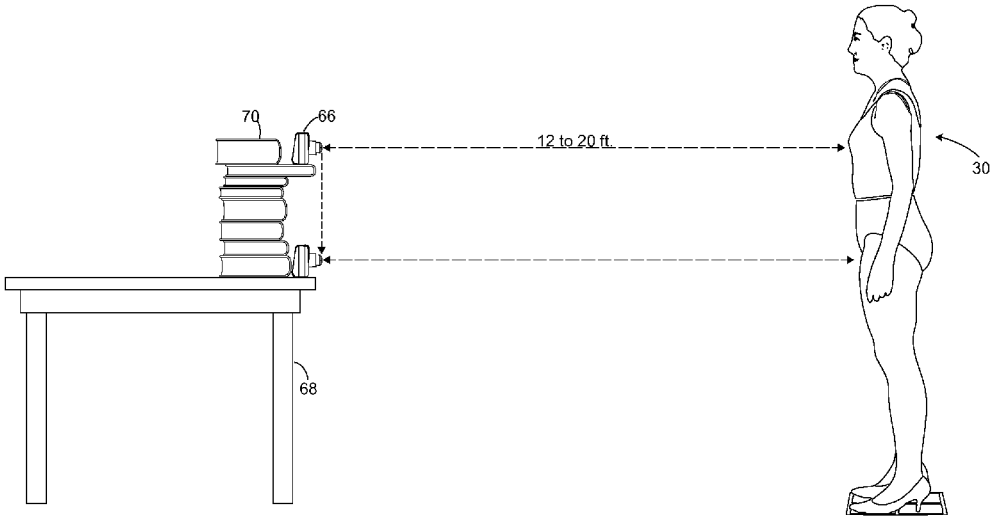
FIG. 12 is a side elevation view of a camera set up for taking the photographs.

Referring to FIG. 12, the relative scale of the photographs is easiest to set if all the photographs are taken by a camera 66 from the same distance and level. Therefore, the camera is preferably coupled to a standard mount, such as a tripod, or rests on another platform with a defined height and distance relative to the subject, such as a table 68 and/or stack of books 70. For the same reasons, it is preferred (though not outside the scope of the invention) that the camera not be handheld by a person. The camera 66 should be 12 to 20 feet away from the subject 30 to avoid distortion. According to a preferred embodiment, two sets of two-dimensional photographs are taken as indicated at step 1044 (FIG. 72), one set taken at approximately the bust level and the other set taken at approximately the crotch level. The camera 66 is placed directly below the first set to take the second set so that the camera remains the same distance and angle from the subject for both sets. Zoom may be used, but it must be the same for both sets of photographs. The top of the head to the tips of the fingers must be seen in the first set of photographs. From just above the waist to the square on the floor must be seen in the second set.

Front, both sides and back photographic views should be taken for each set, as shown in FIG. 13 (first set) and FIG. 14 (second set). The subject's arms should be relaxed at the sides for the upper first set, but not touching or blocking the contour of the hips in the front and back views. The arms should be held above the waist for the lower second set. A final photograph of the lower set, shown at FIG. 15, is preferably a front view with the legs further apart so the crotch level can be seen for pants. To set the scale of the photographs, a yardstick 71 can be placed vertically in the center of the square 36 and a photo taken with the camera in the same position as in the second set of photos, as shown in FIG. 16. As another of various alternatives, the scale can also be set by stitching the upper and lower body photographs together at the outer edges of the waist and using the subject's height for the distance from the top of the head to the center of the square 36.

The digital photos are uploaded into software with computer-aided design (CAD) or photo manipulation functionality, as indicated at step 1046 (FIG. 72). General purpose programs suitable for the following steps include AutoCAD, TurboCAD, TurboCalc and Alibre, although proprietary software programs specifically dedicated to pattern drafting can be used. Additionally, Adobe Photoshop and like programs can be used. Collectively all such programs shall be referred to CAD software or functionality for the description herein. Such CAD functionality can be integrated into the same program by which the user interacts with the online store for viewing and purchasing pattern styles or may be separate therefrom.

Using the CAD functionality, the photographs are cropped and aligned using embedded tools as indicated at step 1048 (FIG. 72). The upper first set photos (FIG. 13) are aligned by the line 64 on the wall. The lower second set photos (FIG. 14) are aligned by the square 36 on the floor, except for the final view (FIG. 15) which is aligned by the narrow elastic 60 is tied around the waist in the photos, as shown at line 70. Aligning makes it possible to transfer marks between views. For example, the back neck mark 42 can be transferred to the side view, as shown at 72. In addition, the crotch level can be transferred from the view in FIG. 15 to all views in FIG. 14 as shown at line 74. The photographs can then be set to a locked layer in the CAD program which can be made invisible after the photographs are outlined.

Figure 17:
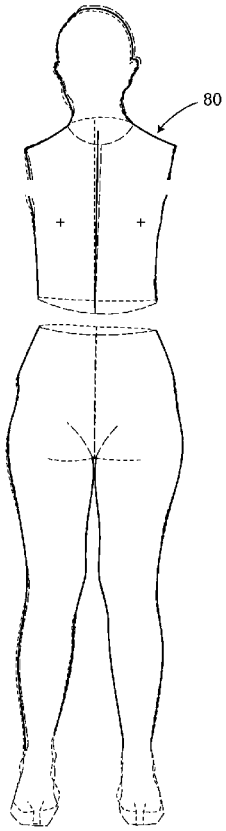
FIGS. 17 through 21 are front and side views illustrating generation of the body outline.
Figure 18:
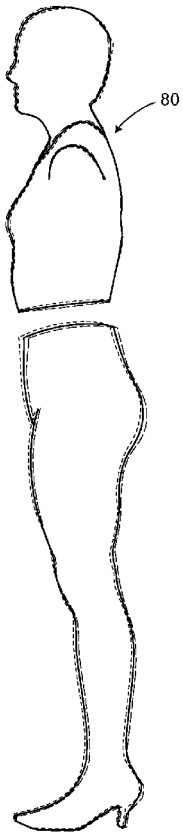

Referring to FIGS. 17 and 18, a body outline 80 on the photographs can be traced by using drawing tools provided by the CAD program (as also indicated at step 1050 in FIG. 72. More preferably, a standard body outline is provided by the CAD program and can be dragged and adjusted to fit the individual's exact shape. Such adjustable standard body outline would preferably carry with it the levels that remain horizontal and the ability to measure the spacing between the levels. In addition, the body outline would include the lines that measure the widths and depths necessary to calculate the multipliers. In addition, the software may also perform edge detection routines that automatically identify the contours of the body as well as the various marker indicia identified by the user with tape, elastic, etc. Thus, after the body outline is identified, it is preferred that the outline form be displayed without the user photographic likeness. However, the photographic likeness may continue to be displayed as well.

Moreover, while it is preferred to draft from a line form body outline derived from a user's photographs, it is recognized that the drafting may be made relative to the scale photographs without the necessity of a separately realized body outline. In such system and method, the software or user will ideally be able to perform edge detection to recognize the boundaries of the photographs, and such boundaries (whether detected automatically by the software or by the user) shall be considered a body outline for purpose of understanding the scope of the invention.

Figure 19:
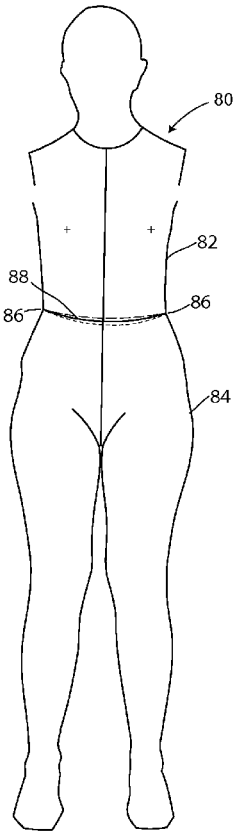
Figure 20:
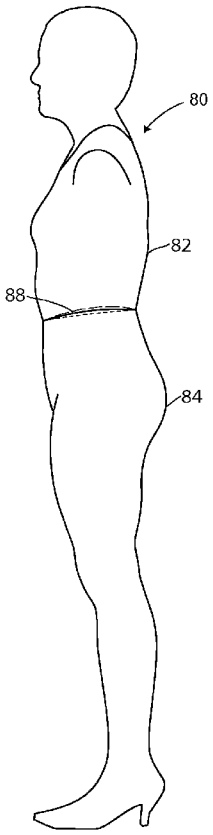
Figure 21:
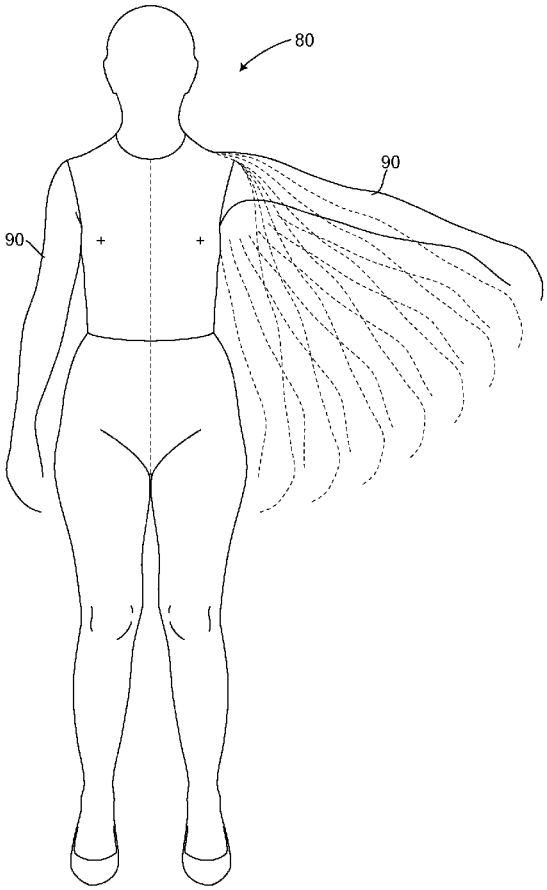

Additional processing may be provided to the body outline at step 1052 in FIG. 72. For example, the resulting body outline is preferably averaged between front and back to make the front and back side seams equal in shape which provides for a better fit. Preferably, the points and lines on the body outline are made with parametric constraints, such that the CAD program performs the averaging automatically. FIG. 17 shows the front and back being averaged by flipping the back vertically and placing it on the front view. FIG. 18 shows that the right and left can be averaged to make the body symmetrical if the user chooses. Referring to FIGS. 19 and 20, once the body outline 80 is averaged, the upper body sections 82 and lower body sections 84 are integrated for each view (front, back, and both sides) by matching the outside edges at the waist 86. The waist curve 88 is then averaged. If there is a slight difference in width or depth of the waist at the edges of the body outline 86, it is preferred that the body outline be averaged as well. Referring to FIG. 21, it is preferred that the arms 90 of the body outline 80 can be raised for drafting dolman and other dropped armhole styles. The arms on the side view can be hidden for seeing the side seam and other details.

Figure 22:
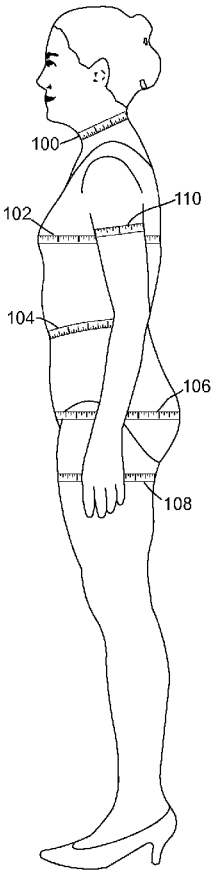
FIGS. 22 and 23 illustrate taking body part circumferences and marking their placement on the body outline.
Figure 23:
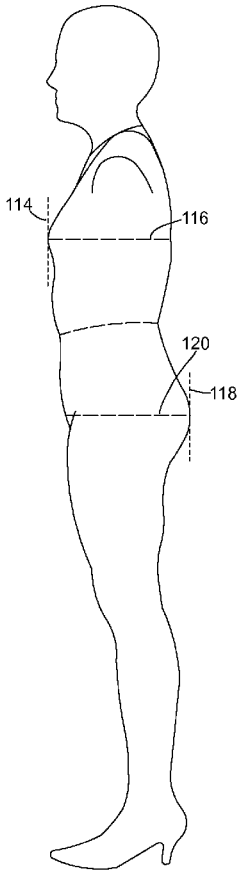

In addition to preparation of the body outline 80, referring to FIGS. 22 and 23, direct measurements from the subject are still required to be obtained (step 1054 of FIG. 73) and then input into the software (at 1056 of FIG. 73), but these measurement are preferably limited to the same six circumference measurements identified above when constructing the mannequin outline: neck circumference 100 (for collars), bust circumference 102, waist circumference 104, hip circumference 106, thigh circumference 108 (for pants) and biceps circumference 110 (for sleeves), which are then manipulated by the software program to modify any selected style drawing and associated pattern for a proper fit garment. The bust, hip, and thigh circumference measurements are preferably taken with a tape measure parallel to the floor. The waist circumference 104 is measured along the waist marking 60. The bust circumference 102 is measured at the fullest point of the bust. The fullest point of the bust need not be marked before the photographs, as such fullest point of the bust is readily determined from the photograph or body outline by using a vertical line 114 to find the widest point of the bust at 116. Similarly, the hip level can be determined by using a vertical line 118 against the buttocks to determine the widest point of the buttocks at 120. Some or all of the circumferential measurements can be taken after the photographs or body outlines have been imaged and can be referenced.

Figure 73:
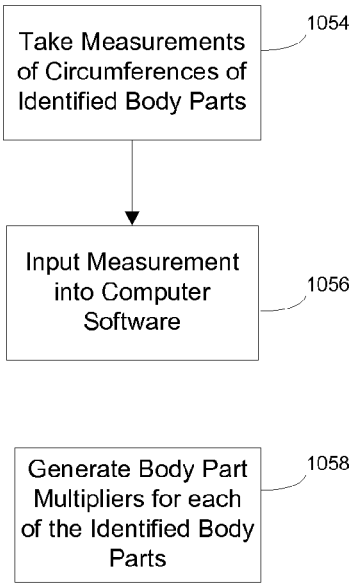
FIG. 73 is a flow chart of a method of generating body part multipliers for a user according to the invention.

As indicated above, the input circumferences are used to generate the user's body part multipliers (BPM) of the respective body parts at step 1058 of FIG. 73. These BPMs are used by the software to make the necessary adjustments to style drawings for altering the contours of the style drawings so that the style drawings appear to properly fit on the user's body outline. In addition, such BPMs will be used by the software to alter the pattern associated with the style drawings so that any output patterns will be properly adjusted to the user.

By way of example, since a tent dress hangs off the bust and is loose through the waist and hips, the bust multiplier is used to adjust the circumference of a tent dress style drawing and its associated pattern at both the bust and hem. A fitted dress requires the bust, waist and hip circumferences to be used in making appropriate adjustments. The hip circumference multiplier would be used for both the hip and the hem. An empire style would use the waist multiplier at the empire (under bust) seam, since the under bust cross section is closer in shape to the waist cross section than the bust cross section. The biceps circumference can be used for the entire sleeve and the upper thigh can be used for the entire pant leg even if the style is very fitted at the ankle. If a style with a hood is required, a head circumference can be used to allow the hood to drape properly, and the same principles apply. From the above, once the BPM is calculated for a body part, flat measurements from the photographs and on the body outline provide accurate input to the software to adjust the style drawings and associated patterns for drafting patterns for well-fitting garments.

Since width and depth measurements from the body outline 80, not the garment style drawing, are used for the multipliers, the multipliers remain the same for each body part on different pattern styles as long as the subject's circumference measurements remain the same. If a user gains or loses some weight and their measurements change, the new circumference measurements can be input into the program and the program preferably automatically adjusts the multipliers, and the garment pattern will be drafted to fit the user's new body shape without having to take new photographs. Moreover, it is also possible to work backwards from the new circumference measurements to change the body outline if the weight is gained in a specific area. For example, if the user gains weight in the abdomen, the new circumference measurements can be used in combination with the previous multiplier to determine how much further their abdomen protrudes now and adjust the body outline accordingly. These changes can be configured within the software program to be relatively automatic upon input of the new measurements.

Figure 74:
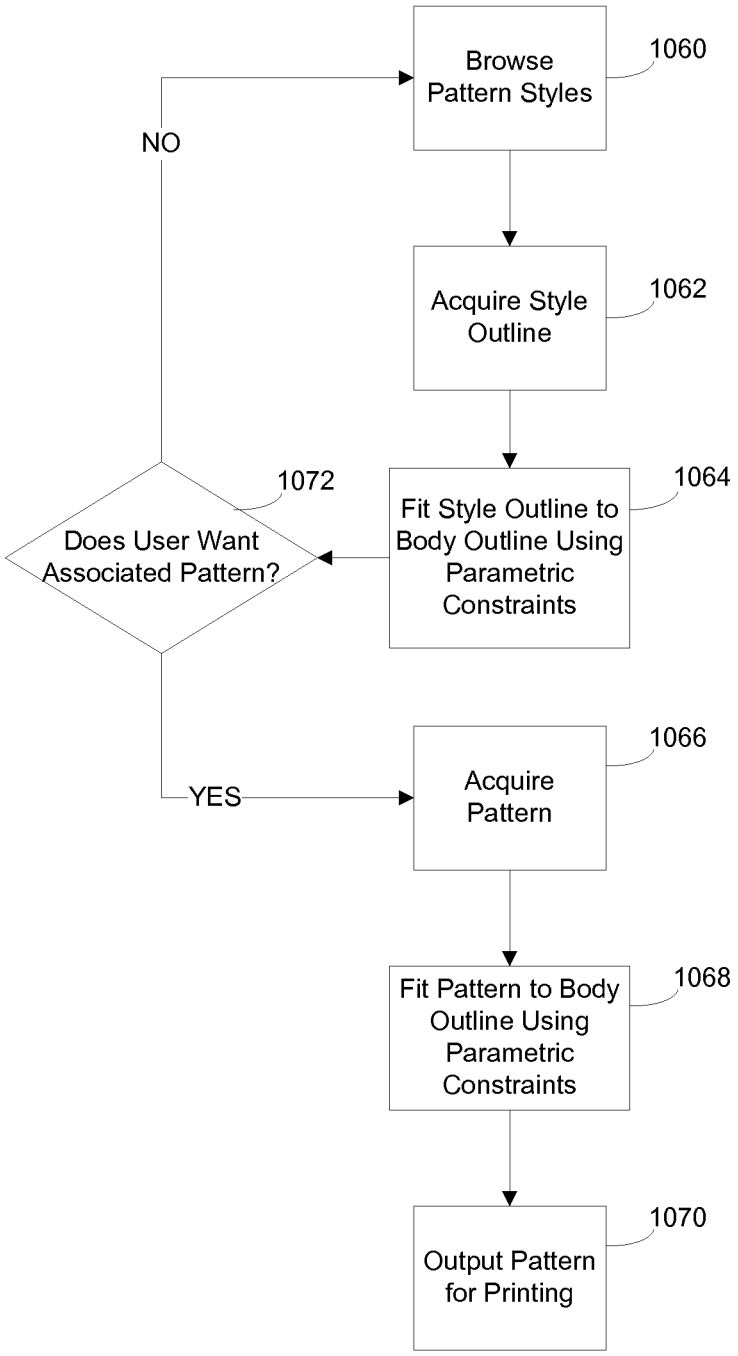
FIG. 74 is a flow chart of pattern drafting according to the invention.

Once the user's body outline is prepared, the user is able to work with the pattern styles in the online store 1022 (FIG. 70). Referring to FIG. 74, the user browses through pattern styles and selects one or more for acquisition at 1060. The user may initially acquire only the style drawing of a pattern style shown at 1062. The style drawing will be fit to the user's body outline 80 at 1064 in accord with the methodology set forth herein. If the user is pleased with how the style drawing appears on the body outline at 1072, the user acquires the pattern from the store at 1066. Alternatively, the user may browse through additional pattern styles at 1060. Once the pattern is acquired, it is adjusted to the user in the same manner as the style drawing was to the user's body outline at 1068. That is, the like or associated parametric constraints in each of the style drawing and pattern permit adjustment made to the style drawing to be mirrored to the pattern. The adjusted pattern can then be output for printing 1070.

The following provides several preferred aspects and considerations that are preferably processed by the software to fit the pattern to the user's body for the drafting of the garment patterns, as previously indicated as step 1068 in FIG. 74. It is preferred that such processing is relatively automatic after the user creates the user body outline and selects a style drawing for use with the body outline. Thus, it is appreciated that the adjustments to the style drawing and associated pattern in overall shape, seam placement, angles, darts, shaping, lengths, widths, slopes, etc. are preferably all in accord with the methods, consideration, and parametric constrains described below.

When a style drawing is selected, it is adapted to automatically register in position over the body outline; i.e., such that the style drawing snaps in position relative to the correct body parts in each of the several views (front, left side, right side, back) of the body outline. To enable such registration, one or both of the body outline and the style drawing may be provided with registration visible or invisible indicia that facilitates the two outlines to be matched in position.

Throughout the following description, references to both the style drawing and the pattern are used, it being recognized that each are changed in the likewise manner based on the same considerations and parameters; the style drawing is adjusted to the body outline, whereas the pattern is drafted to fit the user's actual body.

Figure 24:
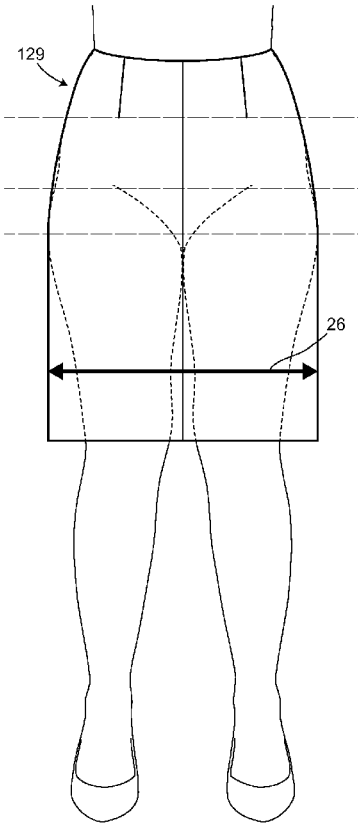
FIGS. 24 and 25 illustrate front and side view of a skirt style drawing and placement of a side seam thereon.
Figure 25:
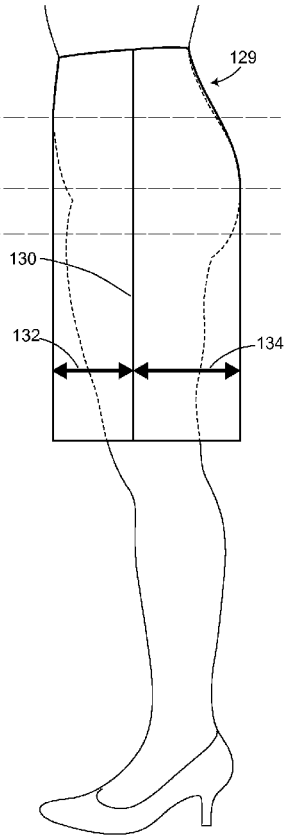

Referring to FIGS. 24 and 25, the side seam for a pattern is where the front piece joins to the back. The side seam is placed in a standard position on most pattern drafting formulas. In the present system and method, it is preferably placed in the ideal position for the respective style drawing 129 for which the pattern has been adapted using multipliers. That is, this is either an automatic placement by the software, e.g., positioning the side seam 130 should be at the approximate center of the waist and also at the approximate center of the hem, as well as along the true vertical; alternatively the user may shift the side seam 130 to the position wanted. The front pattern width of the skirt is found using one half of the full width as measured along line 26 plus the measured depth along line 132, and the resulting sum is multiplied by the hip BPM. The back pattern width of the skirt uses again one half of the full width as measured along line 26 plus the measured depth along line 134, and the sum is multiplied by the hip BPM.

Figure 26:
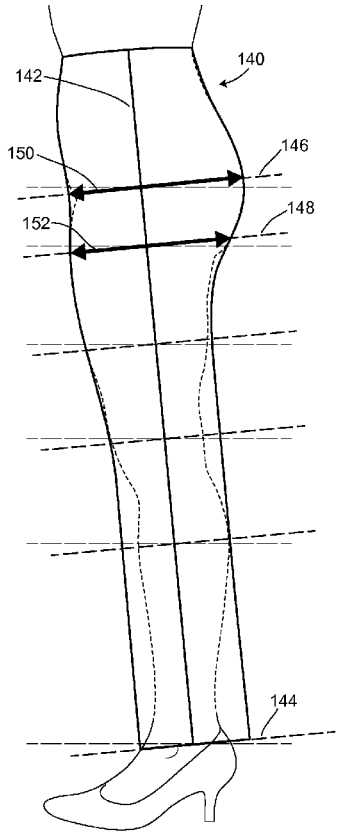
FIG. 26 is a side view of a pant style drawing to illustrate angled seam placement.

Turning to FIG. 26, on some garments it may be desirable to angle the side seam. As shown, the pant style 140 is narrow and the wearer is shown having a forward stance. The side seam 142 is preferably angled so that it is in the approximate center of the waist and hemline 144 when viewed from the side. When the side seam 142 is angled on any garment except a bodice, the levels 146, 148 also angle on the side view at the intersection where they cross the side seam 142, so that they are perpendicular to the side seam 142. The depths for calculating circumferences 150, 152 are measured along the angled level to the garment edges, and the hemline 144 also follows the same angle.

Figure 27:
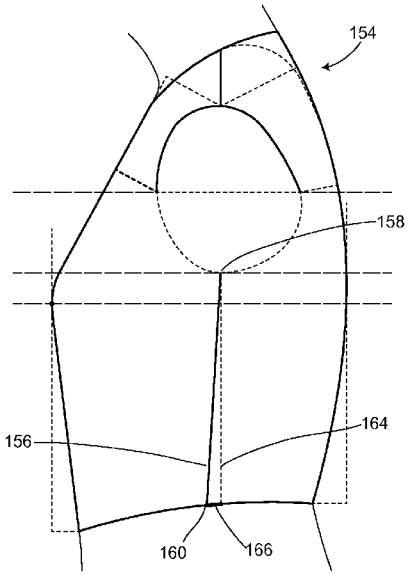
FIG. 27 is a side view of a bodice style drawing to illustrate angled seam placement.

Similarly, as shown in FIG. 27, the bodice 154 also has an angled side seam 156 to keep the top of the seam at the approximate center of the armhole 158 and the bottom 160 at the approximate center of the waist 162. When the bodice side seam 156 is angled, the full circumferences are still calculated using a vertical line 164 and then the side seam 156 on the pattern draft is shifted an amount 166 by which the seam 156 differs from the vertical line 164 as measured on the side view.

Figure 28:
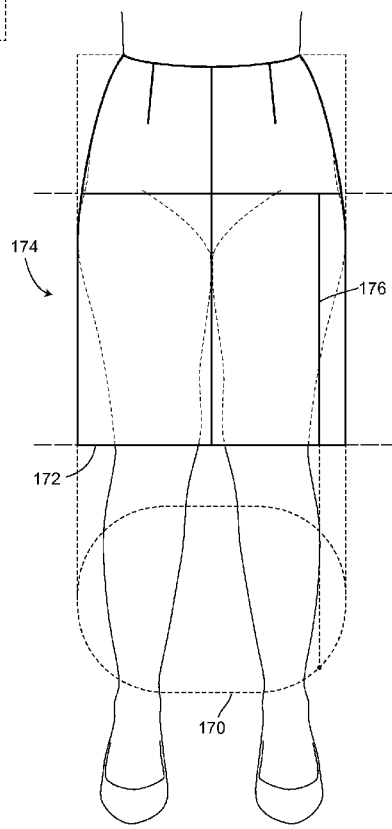
FIGS. 28 and 29 are front and side view of a skirt outline illustrating decorative seam placement.
Figure 29:
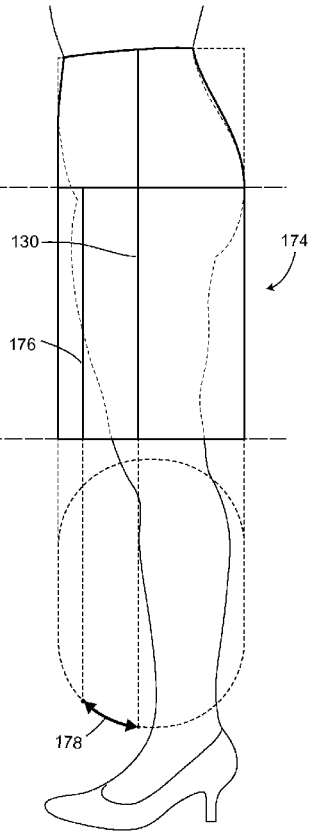

Referring to FIGS. 28 and 29, once multipliers are used to find the full circumferences, the circumference at any level on the style drawing is calculated. Then using the depth, width, circumference and a simple geometric shape (usually a rounded rectangle or an ellipse, or the front could be an arc and the back a rounded rectangle), a cross section for that level is determined. A cross section 170 of the hemline 172 is shown on the front view of a skirt 174 (FIG. 28). The same shape can be rotated 90° and used for the side view (FIG. 29). If a decorative seam 176 is selected (either by inclusion with the purchased pattern style or by inclusion of tools within the software), it can be indicated on the front view and its position can be automatically plotted in the corresponding location in the side view. Its placement on the pattern piece can be determined in the same manner by measuring from the side seam 130, as shown at 178. It could also be measured from the center front.

Figure 30:
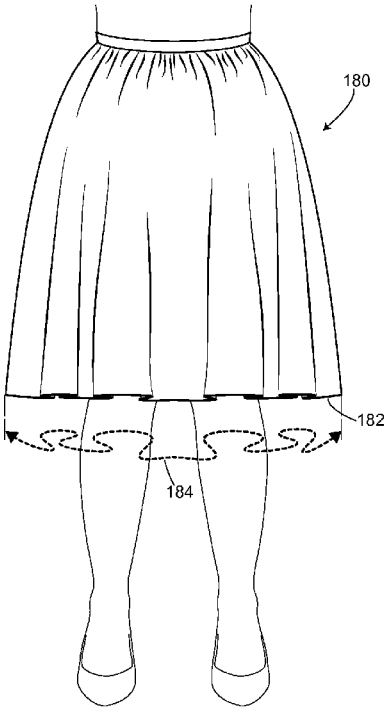
FIG. 30 is a front view of a full skirt.

Very full garments that hang in folds, like the skirt 180 in FIG. 30, cannot be measured using photographs. However, these types of garments do not require that much in the way of fit. The lengths and levels can be measured from the photographs. In addition, it may be possible to estimate the circumference of the skirt 180 by tracing the hemline 182, exaggerating it to line 184, then measuring it and using the appropriate multiplier to find the circumference.

Figure 31:
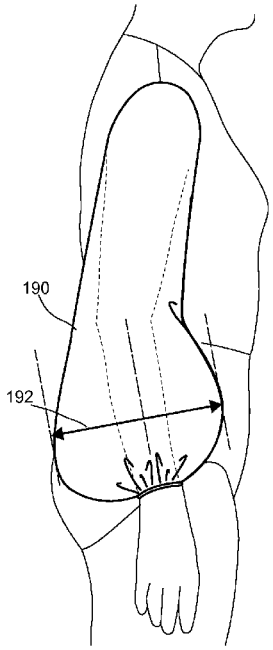
FIG. 31 is a side view of a full sleeve.

In addition, pattern pieces that are not too full to fall in folds, like the sleeve 190 shown in FIG. 31, can be drawn puffed out to their fullest, the width and depth can be measured at their fullest point 192. Then the appropriate multiplier can be used to find the circumference at that level.

Figure 32:
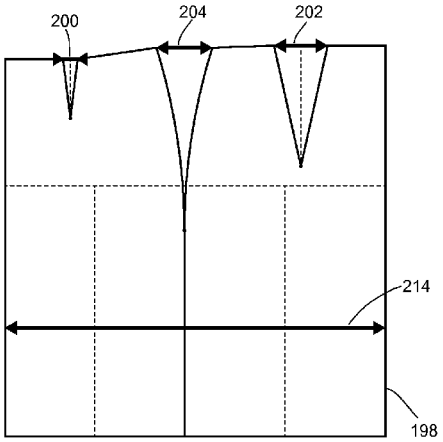
FIG. 32 is a pattern for a skirt.
Figure 33:
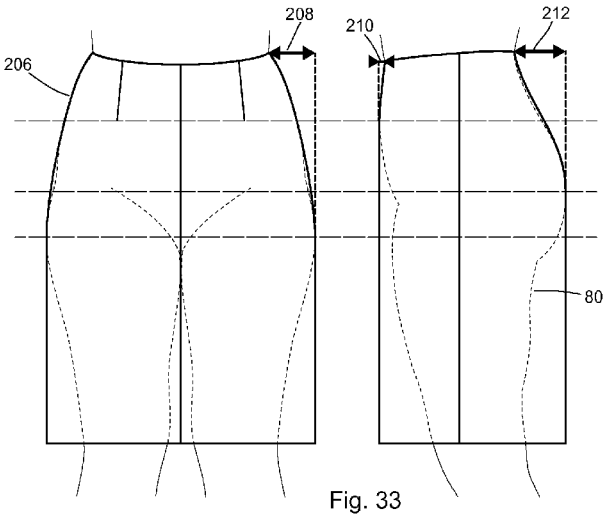
FIG. 33 is front and side views of a style drawing associated with the pattern, illustrating waist dart intakes.

Turning to FIG. 32, a skirt pattern 198 is shown. Waist darts 200 and 202 and the side seam shape or indent 204 are for removing fullness so the garment can fit close to the waist. The amount of fullness that is preferably removed is based on the shape of the body at the dart or side seam position. For example, a woman is generally larger at her buttocks than at her abdomen, so a larger dart is needed on the back skirt than on the front skirt. If the dart intake is too large or too small for an area it will result in wrinkles, drag lines and the pitching of the garment. There is not any way to find dart intakes or side waist indent using a tape measure. Standard drafting formulas use a standard measurement for the side seam indent, coming in a certain amount at the waist to shape the side seam and leaving the left over as the dart intake. However, such method assumes that all women have the same side seam shape, but this is accurate for only a small percentage of the population.

In accord with the invention, proper waist darts and side seam intakes can always be determined for every individual in the entire population. Thus, as indicated above, the patterns include no standard measurements for such darts and intakes which are used or even modified; rather, all such darts and intakes, and the location thereof, are calculated and established in a pattern for each individual. The waist dart and side seam intakes can be found using the body outline 80 and the skirt style drawing 206, by measuring the horizontal distance from the side edges of the skirt to the edges of the waist 208, 210, 212. The relative percentages of the measured indents 208, 210, 212 is used to proportion the dart intakes. The subject's waist circumference is subtracted from the skirt pattern full circumference 214 to find how much dart and side seam intake is needed. The combined indent is measured and added together (208+210+212) to find the amount of dart intake relative to the body outline. The dart intake required divided by the dart intake from the body outline provides a dart multiplier (DM).

DM*indent 208=side seam indent 204;

DM*indent 210=front dart intake 200; and

DM*indent 212=back dart intake 202.

The same method is used for the waist of the pant and for the bodice waist and is also used with modifications for the pant thigh. It can also be appreciated that on looser styles, the indents are measured to the garment edges at the waist and not the body outline edges.

Figure 34:
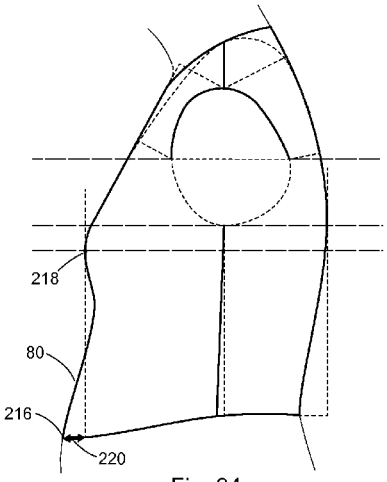
FIG. 34 is a style drawing for a bodice.
Figure 35:
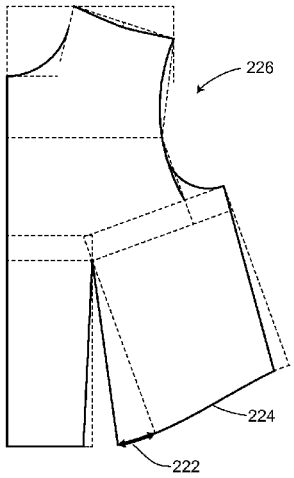
FIG. 35 is an associated pattern for the style drawing, illustrating a bodice waist darts when a waist is wider or deeper than the bust.

Referring to FIGS. 34 and 35, the calculation of bodice waist darts are shown for when the waist is wider or deeper than the bust. If the waist 216 extends beyond the bust 218 on the body outline 80, the horizontal distance 220 is calculated as a negative number and the resulting negative intake 222 is plotted in the opposite direction, making the side waist 224 larger on the bodice pattern 226 instead of smaller. A negative number is also used if the waist is wider than the bust at the side edge of the front view.

Figure 36:
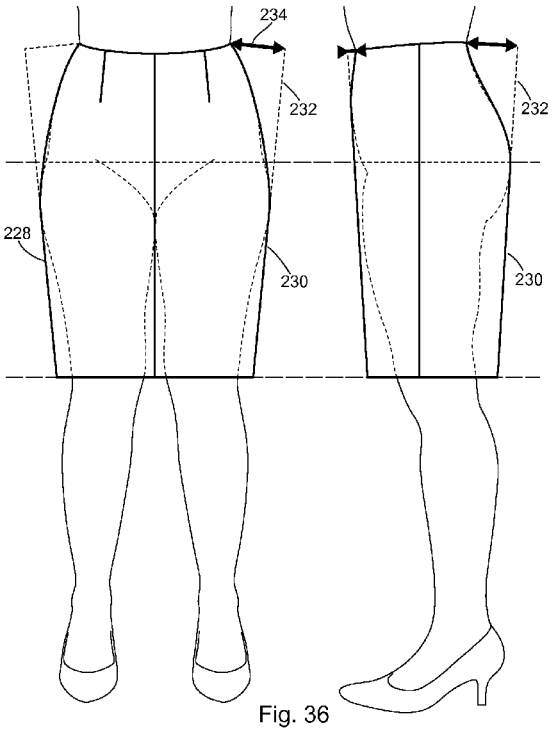
FIG. 36 shows front and side view of a style drawing illustrating waist dart intakes on angled styles.
Figure 37:
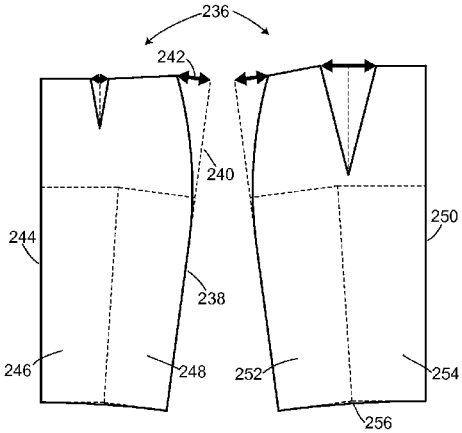
FIG. 37 shows the associated pattern.

Turning to FIGS. 36 and 37, skirt and pant waist dart intakes are based on the continuation of the garment edges below the start of the hip-abdomen curves regardless of whether the garment is straight, tapered (as in the style drawing 228) or A-line. On a drawing of a pattern style, the garment edge line 230 continues straight up along invisible construction line 232. The dart intake measurement from the garment edge to the waist edge 234 always remains perpendicular to the edge of the garment 232. On the associated pattern 236, the side seam 238 continues straight up along construction line 240. The side seam indent 242 is perpendicular to line 240.

This principle assures that the finished garment will be the same shape as the style drawing and allows for the back skirt to hang at a different angle than the front skirt if desired. Standard methods of pattern making generally guess at how much to open or close a dart or angle a side seam to try to achieve the desired shape or silhouette.

Garments that have angled edges such as the tapered skirts shown in FIG. 36, A-line skirts, tent dresses and palazzo pants have their front and back pattern pieces divided into two sections of equal shape that mirror each other. Referring to FIG. 37, front pattern piece 244 has sections 246 and 248 that mirror each other, and back pattern piece 250 has sections 252, 254 that mirror each other. This is accomplished by dividing the pattern hip width in half and dividing the pattern hem width in half. The hip lines and hemlines remain perpendicular to the center front, center back and side seam edges.

This principle allows the resulting garment to curve around the body and remain balanced. The straight lines at the hip and hem can be replaced by curved lines 256 that are tangent to the hip lines and hem lines at their ends.

Figure 38:
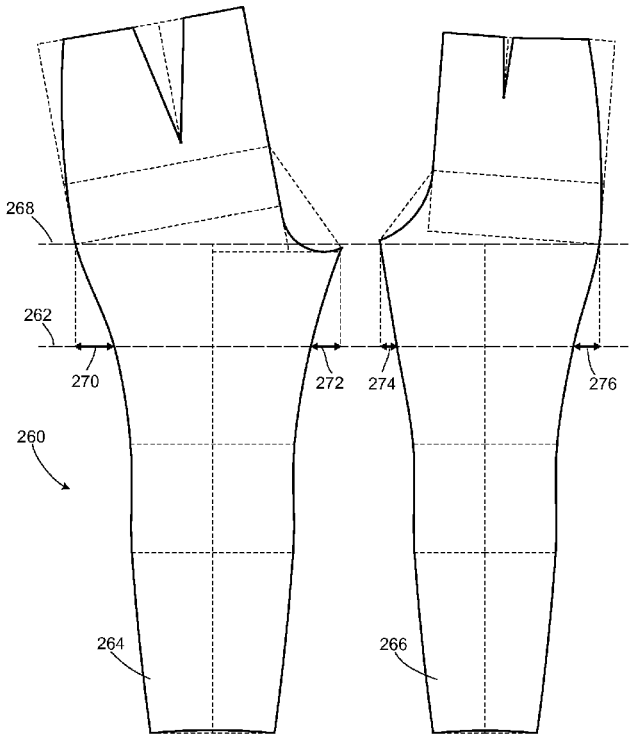
FIG. 38 is a back and front patterns for a pant.

Turning to FIG. 38, a pant pattern 260 is shown. The pant leg from the mid-thigh 262 and below pattern 260 is equal in shape on the out seam, inseam, front and back. The only difference is the back leg 264 of the pattern 260 is one inch wider than the front leg 266. This is standard for most pant pattern drafting methods. When drafting according to the invention, the pant leg circumferences are calculated using the upper thigh multiplier.

The shape and angle of the seams from the crotch level 268 to the mid-thigh 262 is important for fit. This area will determine how the pant legs hang. People have a variety of leg shapes (some are bow-legged, some are knock-kneed for example) and standard pattern drafting formulas do not account for these differences. There is no way to measure these differences using a tape measure.

Figure 39:
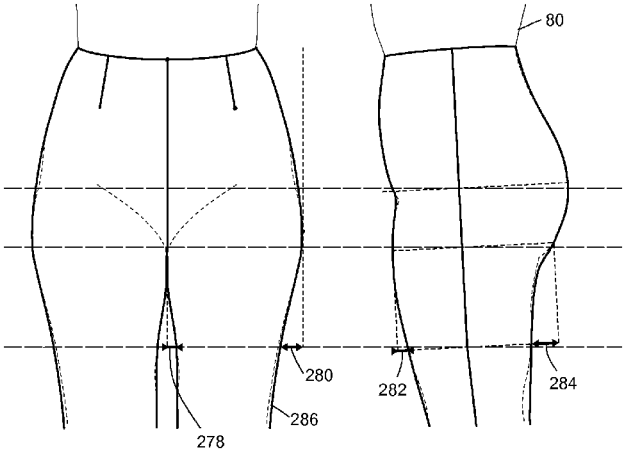
FIG. 39 is front and side view of the style drawing for the corresponding pattern.

Using the user body outline 80 derived from photographs, the horizontal differences from the mid-thigh to the crotch level 270, 272, 274, 276 on the pattern (FIG. 38) and 278, 280, 282, 284 on the style drawing 286 (FIG. 39), are calculated using a multiplier as described above for a waist dart. Since the leg only has two seams and no darts, the resulting intakes are split in half. The back inseam 272 uses half the intake for the back 284 plus half the intake for the inseam 278. The front out seam 276 uses half the intake for the out seam 280 plus half the intake for the front 282, etc.

Figure 40:
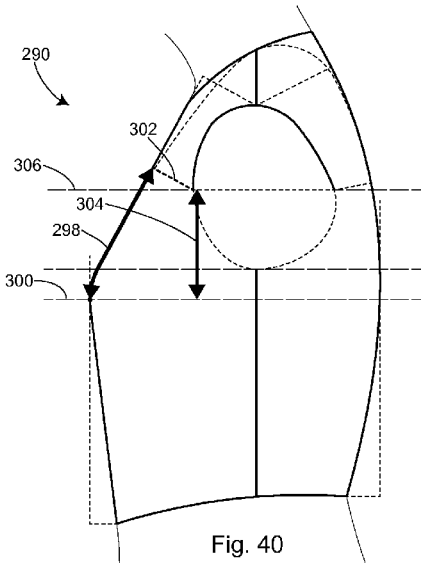
FIG. 40 is a bodice style drawing illustrating measuring for bust darts.
Figure 41:
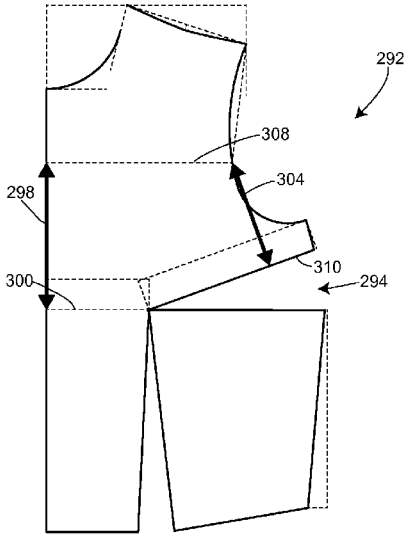
FIG. 41 is the associated pattern for the bodice.

Drafting from a body outline derived from photographs, all non-waist darts are based on differences in lengths. Referring to FIGS. 40 and 41, a bodice style 290 and corresponding front bodice pattern 292 are shown. Since all levels remain parallel to the floor on the photographs, the pattern 292 remains horizontally and vertically balanced, the bust dart becomes a difference in length between the center front length and the armhole depth with both lengths being measured between the bust level and the mid-armhole level. In other words, the bust dart 294 is defined as the difference in length between the center front length 298 from the bust level 300 to the across front chest line 302 and the armhole depth 304 from the bust level 300 to the mid-armhole level 306.

This works because the across front chest line 302 on the side view body outline starts at the intersection of the armhole marking and the mid-armhole level 306 and is perpendicular to the center front. The across front chest line on the pattern 308 is perpendicular to the center front 298. The armhole depth on the pattern 304 is perpendicular to the top dart leg 310.

All of this works together to create the proper dart angle required for perfect fit. There isn't any way to measure a bust dart using a tape measure. Often a woman's cup size is used, but this is not accurate. The dart required for the cup only could be very different from the dart required for a bodice pattern that extends from the shoulder to the waist.

Figure 42:
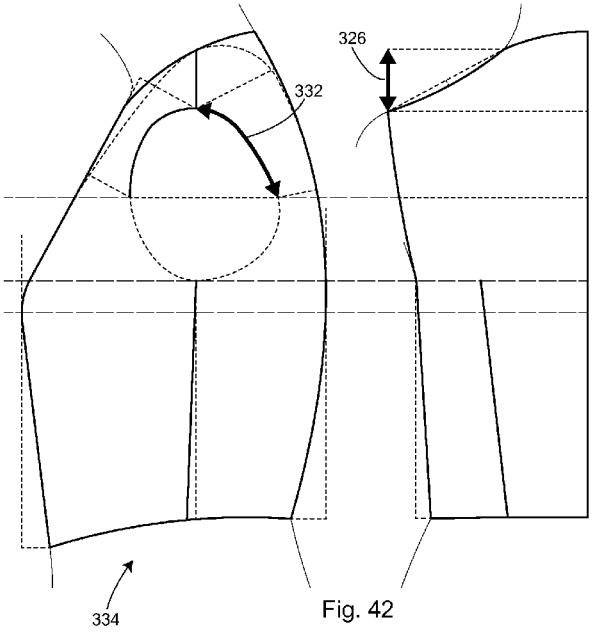
FIG. 42 shows side and left back views of a bodice to illustrate back shoulder dart and shoulder slope measurement.
Figure 43:
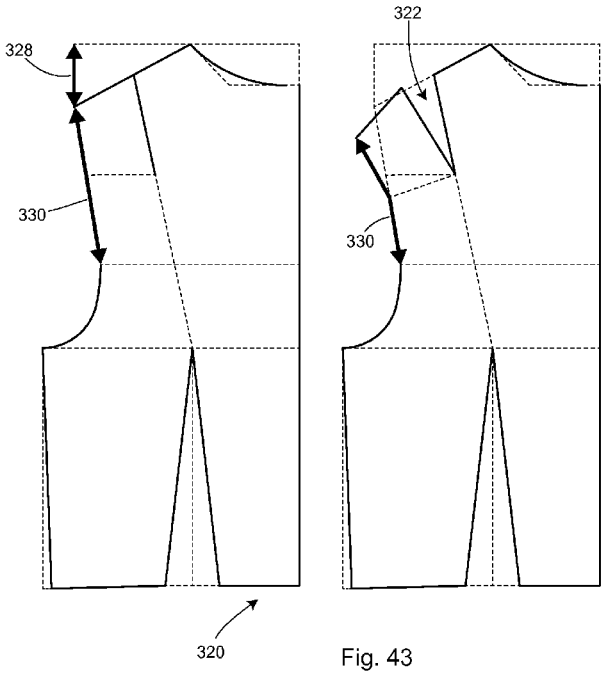
FIG. 43 illustrates corresponding adjustment of the bodice pattern.

Referring to FIGS. 42 and 43, fullness is removed from the back bodice pattern 320 above the bust level by using a back shoulder dart 322 and shoulder slope (angle). Otherwise, extra fullness here would show up on the garment as a gaping back armhole. The back shoulder slope 326 cannot be used as measured directly on the photos, but is used to plot the pattern initially; line 328 is equal to line 326.

The back shoulder dart 322 is formed by shortening the back armhole 330 and pivoting the fullness to the dart so that the upper back armhole of the pattern line 330 is equal to the upper back armhole 332 of the body outline or style drawing 334. This will yield the proper dart intake and shoulder slope required to fit the individual without gaping.

Most pattern drafting methods give the back shoulder dart intake as a standard of ½". Some pattern drafting formulas base the back shoulder dart intake on the shape of the upper back and one has to guess whether they have a flat back, round back or average back. Most formulas don't allow enough intake for someone with a very rounded back such as a dowager's hump.

To keep the garment's grain line running perpendicular to the floor and the cross grains parallel to the floor at the widest parts of the body (which helps achieve balance and good fit), all vertical lengths below the bust level are measured as vertical depths on the true vertical.

Figure 44:
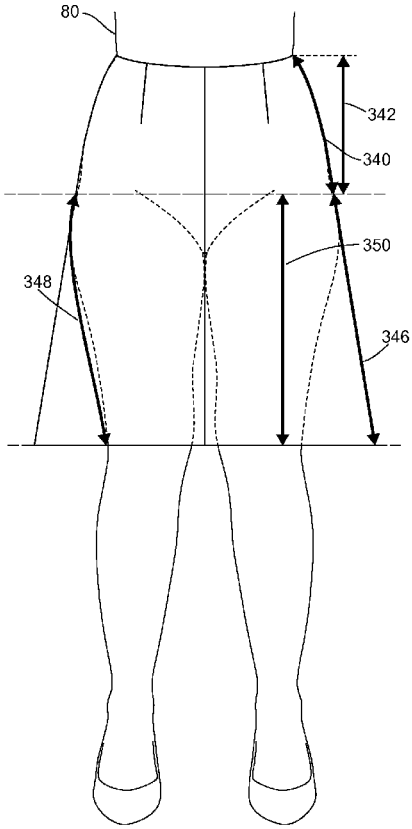
FIG. 44 shows the measurement of vertical lengths below the bust level.
Figure 45:
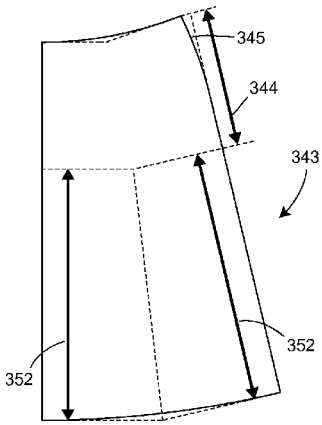
FIG. 45 how such measurements are transferred to the corresponding pattern.

The measurement of vertical lengths is described with respect to FIGS. 44 and 45. The side seam length from the waist to the hip is not measured on line 340; rather it is measured on the body outline 80 on line 342, and plotted on the pattern 343 as a depth, line 344. Once the side seam indent is added to the pattern and the hip curve 345 drawn, the length would end up equal to line 340.

The length of the skirt is also not measured on line 346 since that is a distorted line because of the lack of perspective on the drawing. It is also not measured on line 348, even though that would be one of the few options when measuring on a live person. Rather, the skirt length below the hip is measured as a vertical depth line 350 and placed on the pattern as lines 352.

Using body outlines derived from photographs to measure vertical depths is actually more accurate than using a tape measure, since the tape measure would need to follow the curves of the body.

Figure 46:
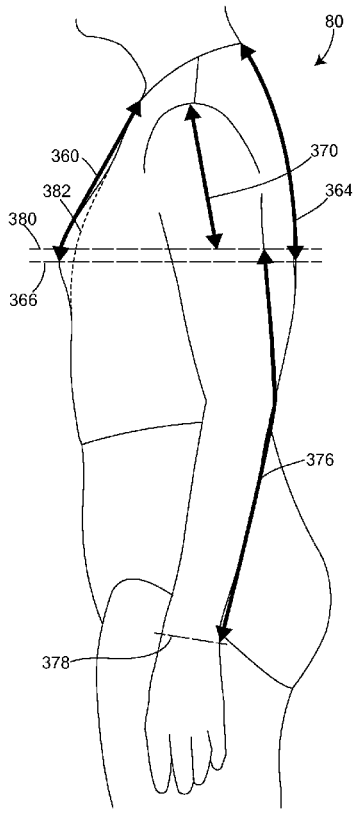
FIGS. 46 through 48 show the measurement of vertical lengths and widths above the bust level.
Figure 47:
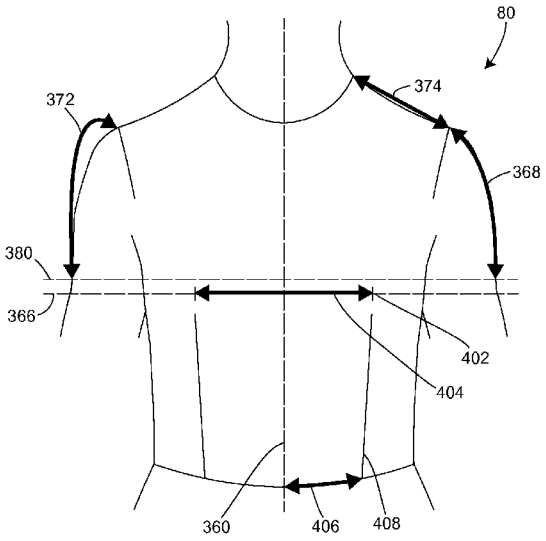

Referring to the outlines in FIGS. 46 and 47, all length measurements above the bust level, as well as the entire sleeve, are preferably measured along the longest line. For example: the center front 360 is measured on the side view along the edge of the body outline. The center back 364 is measured on the side view along the back of the body outline. Both the center front 360 and center back 364 are measured to the bust level 366. Below bust level 366, measurements are measured as vertical depths. When measuring for the center front bodice on an actual person, a tape measure usually slips between the bust as in line 382, yielding an inaccurate measurement. The center front 360 can be accurately measured on the body outline 80, line 360, and the hollows can be filled in to fit like an actual garment would fit. Measuring the center back 364 can also be inaccurate if the tape measure falls between protruding shoulder blades. The center back 364 can be more accurately measured along the back contour of the body on the body outline 80 instead of on the actual body.

The sleeve cap height 368 is measured along the edge of the body outline on the front view and not on the side view at 370. All measurements can also be measured on the style drawing. For example, if the sleeve is puffy, the sleeve cap height 368 can be measured on the style drawing along its outline as line 372. The shoulder length 374 is measured on the front view at the edge of the body.

The sleeve length 376 is measured along the back of the arm in the body outline 80 between wrist level 378 and underarm level 380. The sleeve is not measured as a vertical depth because the arm usually hangs at an angle.

Figure 48:
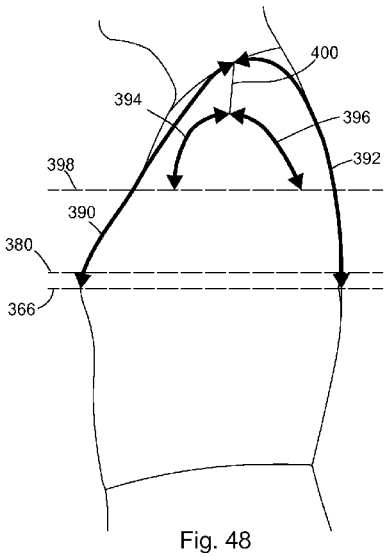

Referring to FIG. 48, the full front length 390 is measured on the side view from the bust level to the shoulder seam along front edge of the body outline or style drawing tapering to the side neck tape marking. The full back length 392 is measured on the side view from the bust level to the shoulder seam along back edge of the body outline or style drawing tapering to the side neck tape marking. The upper front armhole 394 and upper back armhole 396 are measured on the side view along the armhole tape marking from the mid-armhole level 398 to the shoulder seam 400.

Turning now to FIG. 47, widths that do not extend past the boundary points of any one view on the user body outline or style drawing can be measured directed on the body outline or the style drawing. For example, the boundary of the apex 402 and the apex span 404 can be measured directly on the front view of the body outline or style drawing. Another example includes measurement 406 from the center front 360 to the dart leg 406.

Figure 49:
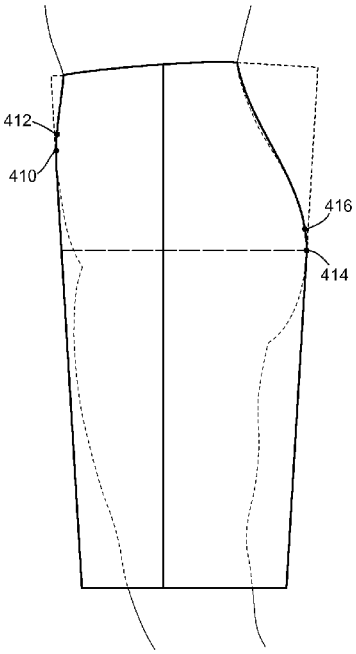
FIGS. 49 and 50 shows the measurement of dart lengths.
Figure 50:
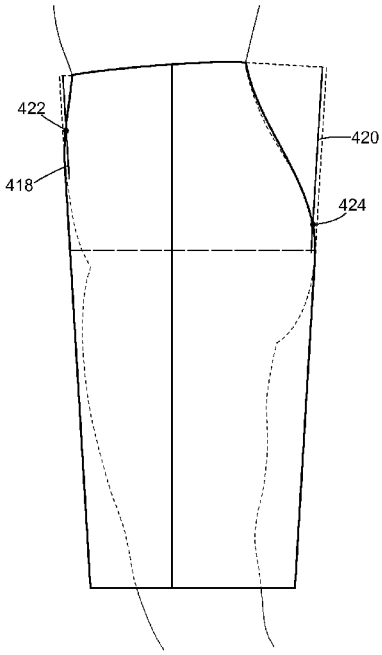

Referring to FIGS. 49 and 50, darts should end ½ inch to 1½ inch shy of the fullest point. This is true for standard pattern drafting as well as for drafting from body outlines. In FIG. 50, the fullest point of the abdomen is at point 410 where the side of the garment touches the abdomen. The dart should end ½ inch above point 410; i.e., at point 412. Point 414 is where the side of the garment touches the buttocks, and is therefore the fullest point of the buttocks. The dart should end approximately one inch above point 414; i.e., at point 416.

Dart lengths may also be determined by offsetting parallel lines 418, 420 ⅛ inch toward the inside of the edge of the garment. Where the lines 418, 420 intersect the edges of the garment, the apexes 422, 424 of the darts are located.

Figure 51:
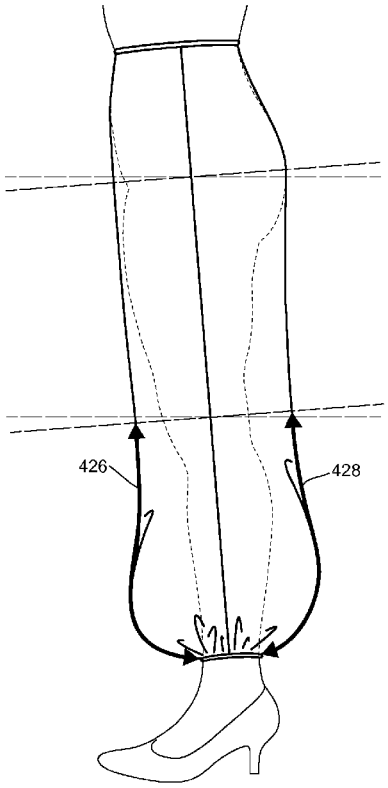
FIG. 51 shows the measurement of vertical lengths that curve into horizontal extensions.

Vertical lengths that change to nearly horizontal, such as full garments that get shirred into narrow spaces, like the harem pants in FIG. 51, must be measured along the curved edges 426, 428 to the nearest level.

Figure 52:
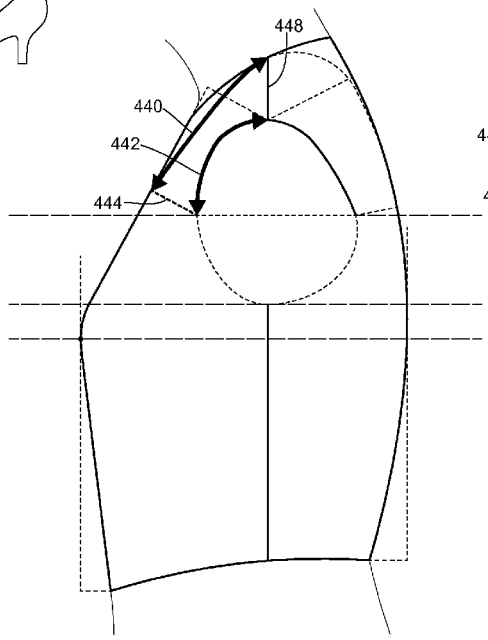
FIG. 52 shows the measurement of the front shoulder slope on a bodice.
Figure 53:
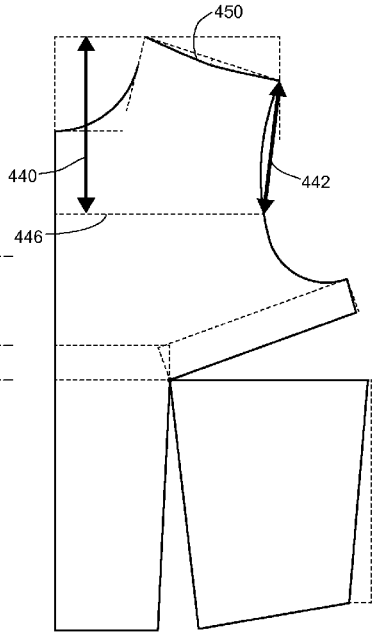
FIG. 53 shows the corresponding measurement on the associated pattern.

Turning now to FIGS. 52 and 53, the shoulder slope on the front bodice pattern is for removing fullness from the front armhole so that the front armhole does not gap. The front shoulder slope is the difference in length between the full front length 440 and the upper armhole length 442 with both lengths being measured from the across front chest line 444, 446 to the shoulder seam 448, 450.

Figure 54:
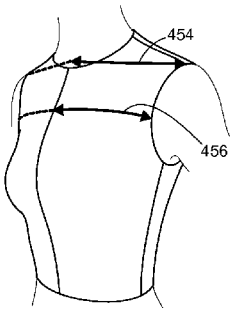
FIG. 54 shows a perspective view of a body.

Referring to FIG. 54, the only measurements that can not be measured on the body outline are across back shoulder, across back armhole, across front shoulder 454, across front chest 456 and the sleeve cap width. These measurements cannot be taken by oneself either, since raising your arms to take the measurement results in distortion.

In accord with the invention, these measurements can be estimated from the body outline with reasonable accuracy using the width from the front or back view body outlines (or style drawing as positioned on the body outline) and the depth from the side view photo/outline as the axes (or sides) of a simple geometric shape that resembles the shape of the body at that point.

Figure 55:
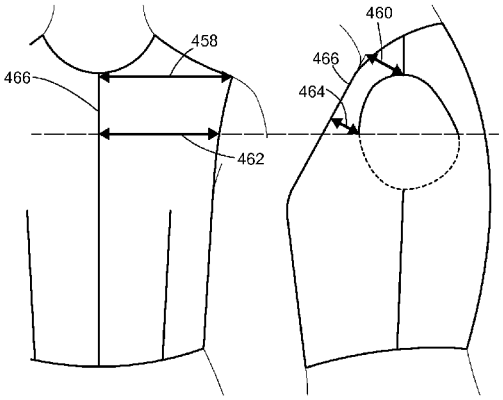
FIG. 55 shows front and side views.
Figure 56:
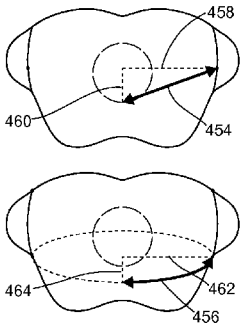
FIG. 56 shows aerial views, all for estimating non-circumferential measurements on the front using geometric shapes.
Figure 57:
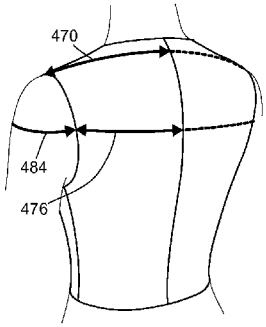
FIG. 57 shows a perspective view of a body.
Figure 58:
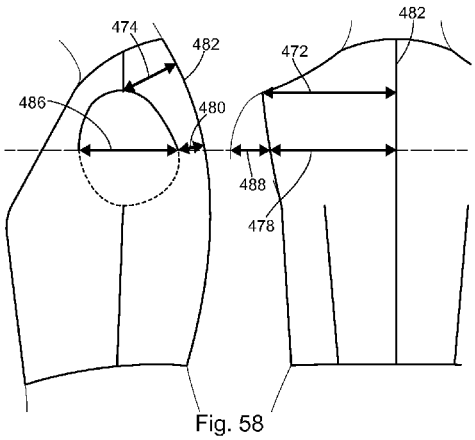
FIG. 58 shows side and back views.
Figure 59:
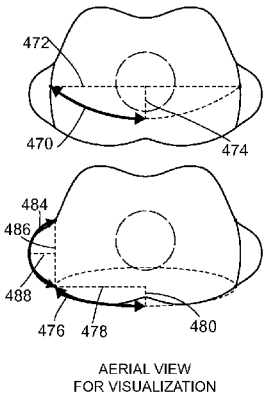
FIG. 59 shows aerial views, all for estimating non-circumferential measurements on the back using geometric shapes.

For example, referring to FIGS. 54 through 56, half the across front shoulder 454 is equal to the length of the hypotenuse of a right triangle using line 458 as one of its legs and line 460 as the other leg. Half the across front chest 456 is equal to ¼ the circumference of an ellipse using line 462 as the semi-major axis and 464 as the semi-minor axis. Lines 458 and 462 are perpendicular to the center front 466. Line 458 extends from the armhole tape at the edge of the shoulder. Line 462 extends from the armhole tape at the mid-armhole level. Line 468 extends from the shoulder seam/armhole intersection and is perpendicular to the center front 466. Line 464 extends from the armhole tape at the mid-armhole level and is perpendicular to the center front 466. Line 460 extends from the shoulder seam armhole intersections and is perpendicular to the center front line 466. Now referring to FIGS. 57 through 59, half the across back shoulder 470 is equal to half the length of an arc using line a line twice the length of line 472 as the chord and line 474 as the sagitta. Half the across back 476 is equal to ¼ the circumference of an ellipse using line 478 as the semi-major axis and line 480 as the semi-minor axis. Lines 472 and 478 are perpendicular to the center back 482. Line 472 extends from the armhole tape at the edge of the shoulder. Line 478 extends from the armhole tape at the mid-armhole level. Line 474 extends from the shoulder seam/armhole intersection and is perpendicular to the center back 482. Line 480 extends from the armhole tape at the mid-armhole level and is perpendicular to the center back 482. The sleeve cap width 484 is equal to the length of an arc using line 486 as the chord and 488 as the sagitta. Lines 486 and 488 are on the mid-armhole level. Line 486 extends between the front and back armhole tape. Line 488 extends from the armhole tape to the edge of the arm or sleeve.

Figure 60:
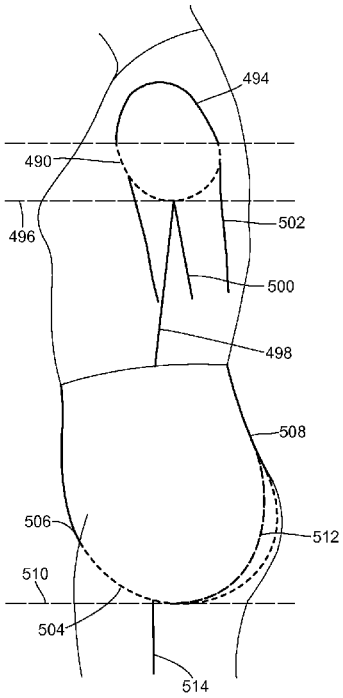
FIG. 60 shows the use of hidden lines.

Referring to FIG. 60, sometimes it may be necessary to estimate and draw in lines that can not be seen in the photographs such as the lower armhole 490 or the crotch line 504. These can be estimated fairly accurately by continuing the curve of the lines from which they extend and making them tangent to the level they touch.

The lower armhole 490 is a continuation of the upper armhole 494 and it touches the armhole level 496 but does not pass thru it. Drawing the lower armhole makes it possible to guarantee that the lower armhole 490, side seam 498, and underarm seam 500 of the sleeve 502 all meet.

The crotch line 504 is a continuation of the abdomen 506 and the lower back 508 and it touches the crotch level 510 but does not pass thru it. The crotch line can be used to measure for garments such as body suits and bathing suits and can be adjusted to fit how the garment should fit. For example; a thong crotch line 512 would sit further in from the body outline.

Drawing the crotch line 504 allows the inseam 514 of a pant to be measured correctly to crotch line 504 instead of to crotch level line 510.

Figure 61:
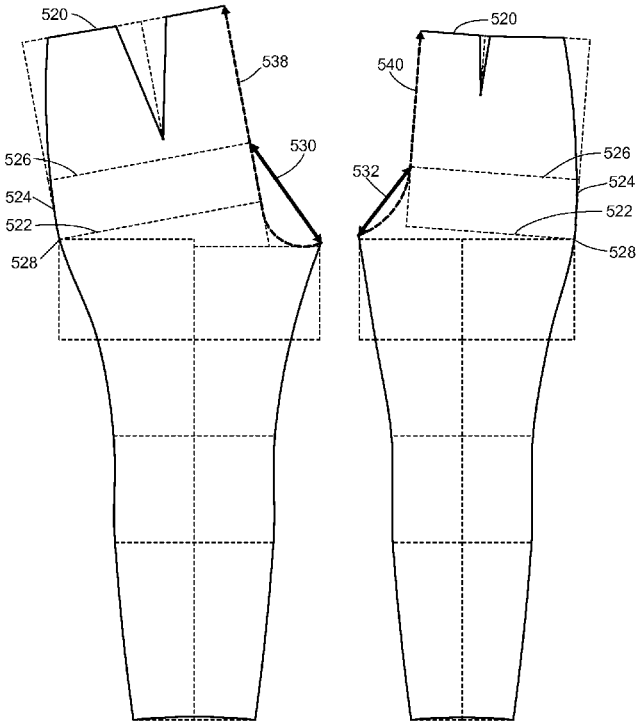
FIG. 61 shows back and front pant patterns.
Figure 62:
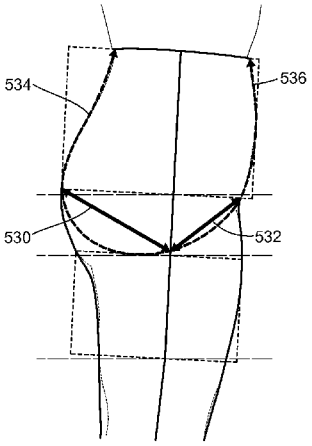
FIG. 62 is a corresponding style drawing, all to illustrate measurement of the pant rise angle and length.
Figure 63:
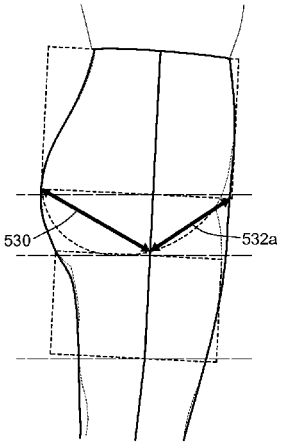
FIG. 63 is similar to FIG. 62, but shows a longer inseam to hip measurement.
Figure 64:
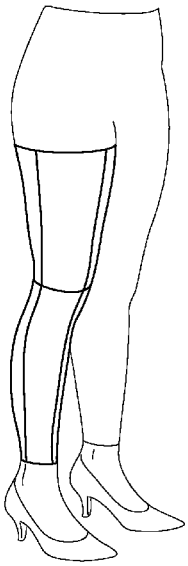
FIGS. 64 through 67 show tracing a body outline in generating a garment pattern.
Figure 65:
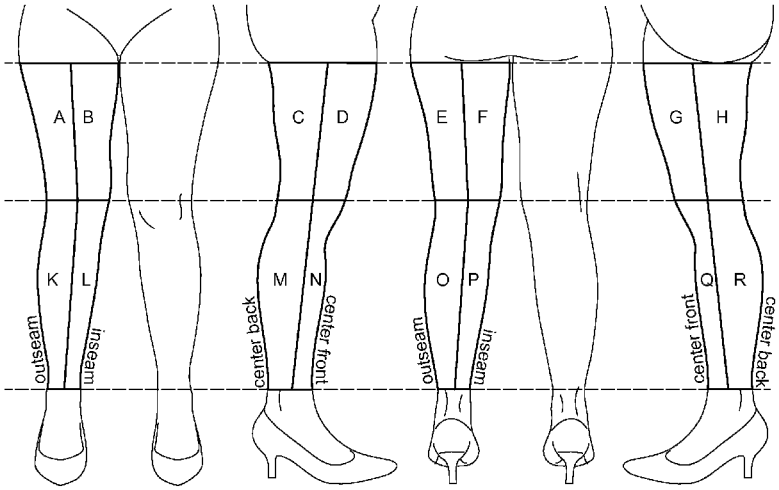
Figure 66:
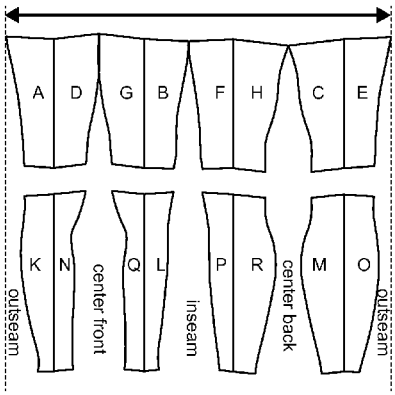

The pant leg has been discussed above. With additional reference to FIGS. 61 and 62, the top section of the pant from the waist 520 to the crotch level 522 is made like a straight skirt except that the side seam 524 from the hip 526 to the crotch level needs to be shaped to follow the style drawing by the use of the hip multiplier. The top section attaches to the leg at the crotch level side seam 528. The top section needs to be angled to make the rise length equal the rise length of the wearer. This is difficult to measure on a person since the tape measure dips into the body more than a pant would. In accord with the invention, diagonal measurements can be made directly on the body outline at 530, 532 (FIG. 62), from the hip level to the inseam/rise curve, and use the same measurement on the pattern draft (FIG. 61) from the top of the inseam to the center front and center back hip. This creates the angle needed for proper fit on the wearer and the correct rise length. The pant rise can be made to fit as tight or as loose as desired. For example, FIG. 63 shows a longer inseam to hip measurement 532*a* to allow the front of the pant to sit away from the front hollow.

Another option is to measure the crotch line on the side view (534, 536) and adjust the angle on the pant draft so that the pattern rise length (538, 540) equals the crotch line length. This is more difficult when using constraints and requires trial and error.

Figure 67:
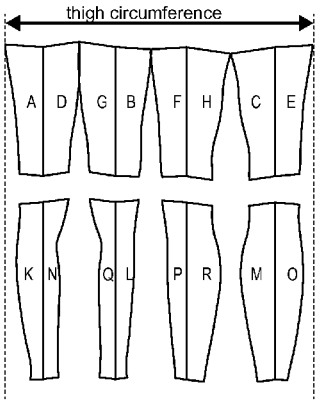

Some shapes can be traced directly from the photographs and adjusted in width (or length) to make pattern pieces. This works well for tubular shapes that have four lengthwise seams. The example in FIGS. 64 through 67 is a pattern for a leg that is very close fitting and might be used for making a pant mannequin. The right leg on all views is traced and may be divided horizontally at the knee. Each section is divided vertically in the approximate center. The sections are placed vertically along their vertical dividing lines. The sections are placed together as a pattern going around the leg would fit. Once all the pieces are placed, the thigh circumference is compared to the thigh circumference of the body. As shown in FIG. 67, all the pieces are reduced equally in width so that the thigh circumference of the pattern is equal to the thigh circumference of the body. This yields a perfect, form fitting leg pattern that fits equally the same at the thigh, knee and ankle and is devoid of pulls and wrinkles. In addition, the seams are all balanced (the pieces are the same shape where the seams join) and appear on the body as perfectly straight lines.

Figure 68:
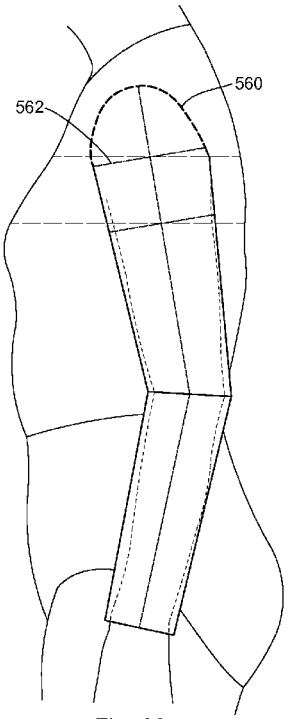
FIGS. 68 and 69 show tracing a sleeve cap to create an associated pattern.
Figure 69:
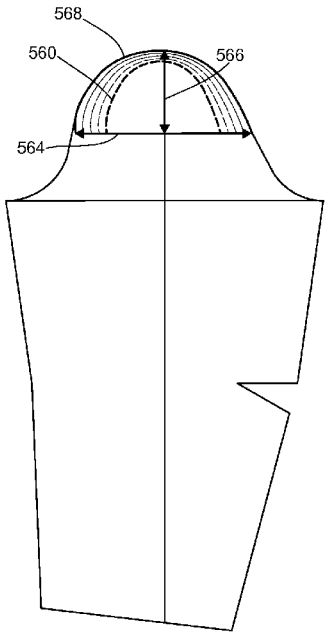

Referring to FIGS. 68 and 69, the sleeve cap 560 above the mid-armhole level 562 can be traced also. Standard drafting formulas have a standard sleeve cap shape, but not all people have the same upper arm shape at the shoulder join. Some have a very rounded front arm and a flat back arm. The sleeve cap can be traced and then it is expanded in width to match the sleeve cap width 564 calculated by using an arc as described above. Then the height of the cap is expanded to match the cap height 566 as measured on the front body outline view. This results in the correct pattern sleeve cap shape 568 for the subject.

It is further aspect of the invention that the user is able to set various preferences for modifications of the patterns. Such preferences may be global or may be for a particular pattern. By way of example, the user may input a selected wearing ease. Wearing ease is a slight increase in circumference measurements to allow for movement and fabric properties. A thick fabric requires more wearing ease than a thin fabric, since a thick fabric takes up more room when curving around a body. Wearing ease can also be negative for stretch fabrics. When wearing ease is input for a pattern, the necessary adjustment are automatically made for the pattern by providing an increase or decrease in pattern dimensions as required.

Once the pattern is fully adjusted based on one or more of the above considerations, the pattern is output for printing at 1070 (FIG. 73).

In accord with another aspect of the invention, the pattern style creator software or another software package is adapted for the needs of a garment designer. The software includes a general mannequin outline, as described above with respect to the pattern style creator system and/or a body outline generator, as described above with respect to the user-side software, which allows a body outline of a designer's fit model or a generic outline for a standard customer, to be generated and stored from photograph image files imported into the software. The body part circumferences for the body to which the garment will be fit, e.g., a mannequin, a standard customer, or a fit model are input into the software. The software provides basic pattern shapes, e.g., silhouettes of skirts, pants, bodices, etc., as well as basic pattern tools to modify the pattern shapes with pleats, shearing, etc. The pattern shapes are formulaic in structure and desired to be automatically adjusted to assume good fit to the body outline based on the input circumferences and measurements from the body outline. The designer places the basic pattern shapes onto the body outline and manipulates the pattern shapes. That is, a basic skirt can be reconfigured between a tapered skirt and an A-line skirt, as desired, and the software ensures the modified skirt maintains appropriate fit the body outline. Once the designer is satisfied with the look of the modified and adjusted pattern shapes on the body outline, image files for the garment patterns pieces are output to a temporary or saved image file for processing by a local printer or transferring to a remote printer. Thus, the software allows a garment designer to visualize a garment and then measure their "vision" so that the drafted pattern reflects their design on the first try, rather than guessing how much to change a sloper and then working to achieve it by trial and error.

In addition to the above described embodiments, it can also be appreciated that the principles, calculations and methods described for measuring the body outline and style drawing can also be applied to traditional garment drafting methods.

From all of the above, it is appreciated that the invention provides for the following novel way in which to draft patterns. Photographic views of the subject are taken from the front, the sides and the back, and such photographs are set to scale. Then a few key circumference measurements are taken from the subject. To facilitate the measurements, an outline is preferably made over the photographs. The desired style of a garment is 'drawn' on the photographs and aligned with the outline. By 'drawn', the style can be created by marking over the photographs or a previously-generated style drawing can be position over the photographs. Using the key circumference measurements as well as measurements from the body photo (in alignment with the body outline) and style drawing, the measurements are plotted to draft a pattern that fits the subject and looks like the style on the first attempt. The invention provides ways of measuring selected circumferences directly the subject, and then obtaining other measurements directly from a two-dimensional representation of the subject, whether that be a body outline, photographs, or scaled drawings, to find the same measurements currently used to draft patterns. Moreover, the invention allows such measurements to be made more accurate since they measure the garment outline instead of the body. Solutions are provided to problems of fit that have not previously been effectively solved.

Further, while the above has been set out with respect to a computerized system, it is further appreciated that the system described can also be applied to non-computerized systems, in which a user obtains the required photographs and works from the photographs with 'pen and paper' to obtain the required measurements and make the required calculations for generation of the pattern. Also, while it is preferred that a user body outline be generated from the photographs, it is understood that measurements and calculations may be directly from the photographs, without an intermediary outline, as the structure which defines the outline can be seen in the photographs.

There have been described and illustrated herein embodiments of a system and method for drafting garment patterns from photographs and style drawings. While particular embodiments of the invention have been described, it is not intended that the invention be limited thereto, as it is intended that the invention be as broad in scope as the art will allow and that the specification be read likewise. In addition, while various formulas have been described for the calculation of patterns, it is recognized that other formulas can also be used. It will therefore be appreciated by those skilled in the art that yet other modifications could be made to the provided invention without deviating from its spirit and scope as claimed.

What is claimed is:

1. A method of drafting garment patterns, comprising:

a) obtaining two-dimensional photographic images of a subject having a body;

b) generating a subject body outline in software from the photographic images, the subject body outline having scaled dimensions corresponding to the body of the subject and upon which measurements can be made;

c) acquiring access to a style drawing, the style drawing being a line representation of at least a portion of a garment and having boundary lines defined by parametric constraints;

d) aligning the style drawing relative to the subject body outline;

e) adjusting the boundaries of the style drawing relative to the subject body outline;

f) providing a pattern associated with the style drawing; and g) automatically drafting a garment pattern to fit the subject corresponding at least in part on the adjustments to the boundaries of the style drawing, the pattern printed or printable on flexible sheet material and including indicia indicating the cuts required for making a garment that corresponds to the style drawing and which fits the subject.

2. A method according to claim 1, wherein:

said obtaining photographic images includes, (i) marking the subject's body, (ii) positioning the subject at a reference location, (iii) taking two-dimensional photographic images of the subject's body from each of a front view, back view, left view, and right view, and (iv) associating a reference measurement in at least one of the photographic images so that the photographic images can be scaled in size to the subject.

3. A method according to claim 2, wherein:

said taking photographic images of the subject's body further includes, taking photographic images of an upper half of the subject's body from each of the front view, back view, left view, and right view, taking photographic images of a lower half of the subject's body from each of the front view, back view, left view, and right view, and aligning the upper and lower half photographic images.

4. A method according to claim 1, wherein:

the subject body outline includes separately displayable front view, back view, left view, and right view, and the style drawings includes a front view, a back view, a left view, and a right view which are aligned relative to the respective view of the body outline.

5. A method according to claim 4, further comprising:

measuring a sleeve cap height along an edge of one of the front view of the subject body outline or the front view of the style drawing.

6. A method according to claim 4, further comprising:

measuring widths that do not extend past boundary points along any one of the front, back, left or right views of the subject body outline or style drawing directly on the one of the front, back, left, or right view of one of the subject body outline and the style drawing.

7. A method according to claim 1, wherein:

said generating the subject body outline includes detecting edges of the subject's body from the photographic images.

8. A method according to claim 1, further comprising:

taking circumferential measurements of a subject body part;

generating a body part multiplier (BPM) for the subject body part, the BPM calculated as the circumferential measurement of the subject body part divided by a combination of a width of the subject body part and a depth of subject body part, the width and depth of the subject body part measured on the subject body outline;

using the body part multiplier, calculating a pattern circumference relative to a measured width and depth at a selected level along the style drawing.

9. A method according to claim 8, wherein:

body part multipliers are separately generated for each of the subject's neck, bust, waist, hip, thigh, and bicep.

10. A method according to claim 1, wherein:

said aligning includes automatically aligning the style drawing in correct location over the subject body outline.

11. A method according to claim 1, further comprising:

creating a style drawing over a non-subject body outline; and defining a pattern associated with the style drawing, the style drawing and the pattern each include parametric constraints such that the pattern is adapted to be adjusted in accord with adjustment to the style drawing.

12. A method according to claim 11, wherein:

pattern styles are uploaded to an online store, and the pattern styles are available for browsing at the online store.

13. A method according to claim 12, further comprising:

downloading the style drawing and the pattern style together from the online retail store.

14. A method according to claim 1, further comprising:

outputting the pattern to a printer.

15. A method according to claim 1, wherein:

the pattern includes darts and intakes, and the darts and intakes are calculated for the pattern based on the parametric constraints.

16. A method according to claim 1, wherein:

the pattern includes intakes about the circumference of the pattern, each intake calculated based on its relative percentage of a total measured horizontal indent distance for all the intakes as measured on the style drawing relative to the body outline.

17. A method according to claim 1, wherein:

the pattern includes a dart intake, the dart intake calculated along a perpendicular from an imaginary construction line to a waist line on the subject body outline, the imaginary construction line being a straight extension of an edge of the style drawing below a start of a hip-abdomen curve on the subject body outline.

18. A method according to claim 1, wherein:

the pattern includes a non-waist dart, and the non-waist dart is calculated as the difference between two lengths measured on at least one of the subject body outline and the style drawing.

19. A method according claim 1, further comprising:

measuring a vertical length on at least one of the subject body outline and the style drawing include, the vertical length situated below a bust level and measured on the at least one of the subject body outline and the style drawings as a vertical depth on a true vertical.

20. A method according to claim 1, further comprising:

measuring a length measurement between two points of interest on at least one of the subject body outline and the style drawing, said length measurement situated above a bust level and measured along a longest line of the at least one of the subject body outline and the style drawing between said two points of interest.

21. A method according to claim 1, further comprising:

estimating measurements using known relationships for a simple geometric shape to which a width at a vertical height of one of a front view and a back view of one of the subject body outline and the style drawing, and a depth at the vertical height from a side view of one of the subject body outline and the style drawing can be related.

22. A method according to claim 1, further comprising:

adding lines to the generated subject body outline by continuing incomplete curving lines and making the continued curving lines tangent to a structural level the curving lines contact.

23. A method according to claim 1, further comprising:

tracing shapes directly on one of the photographic images and the subject body outline; and adjusting the pattern to the traced shape.

24. A method according to claim 23, wherein:

said adjusting the pattern to the traced shape includes expanding or contracting the traced shape to match a width or length measured or estimated relative to the subject body outline.

25. A method according to claim 1, wherein:

prior to adjustments to the boundaries of the style drawing, the pattern has no pre-set standard dimensions, angles, and sizes.

26. A method of drafting a garment pattern, comprising:

a) obtaining two-dimensional photographic images of a subject having a body, including,
   (i) marking the subject's body,
   (ii) positioning the subject at a reference location,
   (iii) taking two-dimensional photographic images of the subject's body from each of a front view, back view, left view, and right view, and
   (iv) associating a reference measurement in at least one of the photographic images so that the photographic images can be scaled in size to the subject;

b) manipulating the photographic images, including,
   (i) scaling the photographic images in size to the subject, and
   (ii) from the edges of the subject's body in the photographic images, generating a subject body outline;

c) generating body part multipliers for each of selected body parts, said selected body parts including a neck, bust, waist, hip, thigh, and bicep, said generating including,
   (i) taking circumferential measurements of the selected body parts; and
   (ii) for each selected body part, calculating a respective body part multiplier for the body part, the body part multiplier calculated as the circumferential measurement of the subject body part divided by a combination of a width of the subject body part and a depth of subject body part, the width and depth of the subject body part measured on the body outline, d) browsing a plurality of garment pattern styles, each pattern style having a style drawing and an associated pattern;

e) acquiring access to a style drawing and its associated pattern of one of said plurality of pattern styles;

f) registering the style drawing in correct location over the subject body outline;

g) adjusting the boundaries of the style drawing relative to the subject body outline using parametric constraints;

h) calculating a plurality of pattern circumferences relative to associated width and depths along the style drawing using the body part multipliers; and i) based on adjustments to the boundaries of the style drawing, automatically drafting the pattern, the pattern printed or printable on flexible sheet material and including indicia indicating the cuts required for making a garment that corresponds to the style drawing and which fits the subject.

27. A method of drafting garment patterns, comprising:

a) obtaining two-dimensional photographic images of a subject having a body, including,
   (i) marking the subject's body,
   (ii) positioning the subject at a reference location,
   (iii) taking two-dimensional photographic images of the subject's body from each of a front view, back view, left view, and right view, and
   (iv) associating a reference measurement in at least one of the photographic images so that the photographic images can be scaled in size to the subject;

b) manipulating the photographic images, including,
   (i) scaling the photographic images in size to the subject,
   (ii) from the edges of the subject's body in the photographic images, generating a subject body outline;

c) obtaining subject measurements of selected circumferences of body parts of the subject;

d) registering a style drawing in location over the subject body outline, the style drawing being a line drawing representation of a garment in which the lines thereof have parametric constraints;

e) adjusting the boundaries of the style drawing relative to the subject body outline; and f) based on adjustments to the boundaries of the style drawing, automatically adjusting a pattern that is linked by formulas to the style drawing and the subject measurements, the pattern prior to input of the subject measurements having no pre-set standard dimensions, angles, and sizes, and the resulting pattern printed or printable on flexible sheet material and indicia indicating the cuts required for making a garment that corresponds to the style drawing and which fits the subject.

28. A method of drafting garment patterns, comprising:

a) obtaining two-dimensional photographic images of a subject having a body, including,
   (i) marking the subject body,
   (ii) positioning the subject at a reference location,
   (iii) taking two-dimensional photographic images of the subject's body from each of a front view, back view, left view, and right view, and
   (iv) associating a reference measurement in at least one of the photographic image so that the photographic images can be scaled in size to the subject;

b) manipulating the photographs, including,
   (i) scaling the photographs in size to the subject, and
   (ii) from the edges of the subject's body in the photographic images, generating a subject body outline;

c) tracing a shape of a limb on the subject body outline;

d) dividing the shape vertically;

e) positioning the divided sections vertically along the respective vertical dividing lines;

f) positioning the dividing sections as a pattern for placement around the limb;

g) comparing the pattern circumference to the limb circumference; and h) adjusting the pattern in width, as necessary, so that a circumference of the pattern corresponds to the circumference of such body part on the subject body outline.

29. A method according to claim 28, further comprising:

after tracing the shape, dividing the shape horizontally at a joint of the limb.

30. A method of drafting a garment pattern, comprising:

a) obtaining two-dimensional photographic images of a subject having a body, including, (i) marking the body of the subject, (ii) positioning the subject at a reference location, (iii) taking photographic images of the body of the subject from each of a front view, back view, left view, and right view, and (iv) associating a reference measurement in a photographic image so that the photographic images can be scaled in size to the subject, (v) scaling the photographic images in size to the subject;

b) defining a body outline relative to the photographic images, the body outline having scaled dimensions corresponding to the body of the subject and upon which measurements can be made;

c) providing a style drawing of a garment on the body outline, the style drawings having an edge; and d) drafting a garment pattern from both the style drawing and at least one of the following additional drafting steps of, (i) calculating at least one of a circumference of the pattern at a selected level on the pattern and a side seam placement at a selected level on the pattern, said calculating including, (A) taking a circumferential measurement of a selected body part including the selected level, the selected body part including at least one of a neck, a bust, a waist, a hip, a thigh, and a bicep, (B) measuring a width and a depth of the selected body part on the body outline, (C) calculating a body part multiplier for the selected body part, the body part multiplier calculated as the circumferential measurement of the selected body part divided by a combination of the width of the selected body part and the depth of the selected body part, and (D) using the body part multiplier along with a width and a depth of the style drawing at the selected level to calculate the circumference of the pattern at the selected level or a related level, (ii) calculating a waist dart or intake of the pattern about the narrowest circumference of the pattern based on its relative percentage of a total measured horizontal indent distance for all the intakes as measured on the style drawing from a widest point to a narrowest point, (iii) calculating a waist dart or intake of the pattern along a perpendicular from an imaginary construction line to a waist line on the body outline, the imaginary construction line being a straight extension of an edge of the style drawing below a start of a hip-abdomen curve on the body outline, (iv) calculating a non-waist dart of the pattern as a difference between two lengths measured on at least one of the body outline and the style drawing, (v) measuring a sleeve cap height of the pattern along an edge of one of the front view of the body outline or the front view of the style drawing, (vi) measuring a vertical length for the pattern on at least one of the body outline and the style drawing, the vertical length situated below a bust level and measured on at least one of the body outline and the style drawings as a vertical depth on a true vertical, (vii) measuring a length measurement for the pattern between two points of interest on at least one of the body outline and the style drawing, said length measurement situated above a bust level and measured along a longest line of the at least one of the body outline and the style drawing between said two points of interest, (viii) measuring a width of the pattern, said width not extending past boundary points along any one of the front, back, left or right views of the body outline or style drawing directly on the one of the front, back, left, or right view of one of the body outline and the style drawing, (ix) estimating measurements on the pattern using known relationships for a simple geometric shape, to which both (A) a width at a vertical height of one of a front and back view of one of the body outline and the style drawing, and (B) a depth at the vertical height from a side view of one of the body outline and the style drawing can be related, (x) measuring on the side view from an inseam at a crotch line to a pant style outline at a hip level to calculate a rise angle and a rise length of a pant pattern, and (xi) tracing shapes directly on one of the photographic images and the body outline, adjusting the pattern to the traced shape, said adjusting including one of expanding and contracting the traced shape to match a width or length measured or estimated relative to the body outline, and using the expanded or contracted shape to form at least part of the pattern.

31. A method according to claim 30, wherein:

said drafting includes at least two of the additional drafting steps.

32. A method according to claim 30, wherein:

said drafting includes at least three of the additional drafting steps.

33. A method to draft a garment pattern for a subject, comprising:

a) obtaining front, back and side two-dimensional scaled views of the subject;

b) obtaining selected circumferential measurements directly from selected body parts of the subject;

c) obtaining measurements directly from the two-dimensional scaled views of the subject;

d) positioning a two-dimensional garment style in alignment over the two-dimensional views of the subject;

e) obtaining measurements from the two-dimensional garment style; and f) plotting the measurements to draft the pattern.

* * * * *